US010066468B2

(12) United States Patent
Farebrother et al.

(10) Patent No.: US 10,066,468 B2
(45) Date of Patent: Sep. 4, 2018

(54) DOWNHOLE PUMPING APPARATUS AND METHOD

(71) Applicant: LIFTECK INTERNATIONAL INC., Calgary, Alberta (CA)

(72) Inventors: Guy William Farebrother, Calgary (CA); Serge Gilbert Bonnet, Calgary (CA); Rodney K. Ridley, Edmonton (CA)

(73) Assignee: LIFTECK INTERNATIONAL INC. (CA)

( * ) Notice: Subject to any disclaimer, the term of this patent is extended or adjusted under 35 U.S.C. 154(b) by 200 days.

(21) Appl. No.: 14/892,476

(22) PCT Filed: May 28, 2013

(86) PCT No.: PCT/CA2013/000519

§ 371 (c)(1),
(2) Date: Nov. 19, 2015

(87) PCT Pub. No.: WO2014/190406

PCT Pub. Date: Dec. 4, 2014

(65) Prior Publication Data

US 2016/0130920 A1 May 12, 2016

(51) Int. Cl.

| | |
|---|---|
| ***E21B 43/12*** | (2006.01) |
| ***E21B 43/18*** | (2006.01) |
| ***F04B 47/08*** | (2006.01) |

(52) U.S. Cl.

CPC ..... *E21B 43/122* (2013.01); *E21B 43/121* (2013.01); *E21B 43/123* (2013.01); *E21B 43/18* (2013.01); *F04B 47/08* (2013.01)

(58) Field of Classification Search

CPC ..... E21B 43/122; E21B 43/121; E21B 43/12
See application file for complete search history.

(56) References Cited

U.S. PATENT DOCUMENTS 2,132,738 A * 10/1938 Knox ..... F04F 1/18 417/142
2,136,229 A 11/1938 Baldwin et al.
(Continued)

FOREIGN PATENT DOCUMENTS

CA 1167760 5/1984
CA 2248293 3/2000
(Continued)

*Primary Examiner* — Matthew R Buck
*Assistant Examiner* — Aaron L Lembo
(74) *Attorney, Agent, or Firm* — Terrence N. Kuharchuk; Rodman & Rodman LLP

(57) ABSTRACT

An apparatus including a sealing device for sealing a wellbore, a first pump for pumping fluids from a lower wellbore section, a pump drive powered using wellbore gas, a gas inlet for supplying the pump drive with wellbore gas, and a gas outlet for exhausting wellbore gas to an upper wellbore section from the pump drive. The apparatus may further include a second pump for pumping fluids from the upper wellbore section into the lower wellbore section, a vent for venting wellbore gas to the upper wellbore section, and a switch for controlling the pump drive. A method for moving fluids in a wellbore including sealing the wellbore, supplying wellbore gas to a pump drive and driving a first pump with the pump drive. The method may further include driving a second pump with the pump drive and venting the wellbore gas to an upper wellbore section.

37 Claims, 9 Drawing Sheets

(56) References Cited

U.S. PATENT DOCUMENTS

| | | | | | |
|---|---|---|---|---|---|
| 2,252,047 | A | | 8/1941 | Steenbergh | |
| 3,884,299 | A | * | 5/1975 | McCarter | E21B 43/122 166/68 |
| 4,405,291 | A | | 9/1983 | Canalizo | |
| 4,465,435 | A | | 8/1984 | Copas | |
| 4,516,917 | A | | 5/1985 | Copas | |
| 4,596,516 | A | | 6/1986 | Scott et al. | |
| 4,624,310 | A | * | 11/1986 | Echols | E21B 34/102 166/105.5 |
| 4,730,991 | A | | 3/1988 | Handfield | |
| 5,296,153 | A | * | 3/1994 | Peachey | B04C 5/00 166/265 |
| 5,301,749 | A | * | 4/1994 | Fischer | B01D 17/0214 166/54 |
| 5,857,519 | A | * | 1/1999 | Bowlin | E21B 43/121 166/105.6 |
| 5,860,795 | A | | 1/1999 | Ridley et al. | |
| 6,068,053 | A | * | 5/2000 | Shaw | E21B 43/121 166/267 |
| 6,125,936 | A | * | 10/2000 | Swisher | E21B 43/121 166/265 |
| 6,138,758 | A | * | 10/2000 | Shaw | B04C 5/00 166/105.5 |
| 6,158,967 | A | | 12/2000 | Dupré | |
| 6,167,965 | B1 | * | 1/2001 | Bearden | E21B 43/121 166/105.5 |
| 6,234,770 | B1 | | 5/2001 | Ridley et al. | |
| 6,322,333 | B1 | | 11/2001 | Knight | |
| 7,204,314 | B2 | | 4/2007 | Lauritzen et al. | |
| 7,546,870 | B1 | | 6/2009 | Dotson | |
| 7,566,208 | B2 | | 7/2009 | Santos | |
| 7,789,142 | B2 | | 9/2010 | Dotson | |
| 8,171,997 | B2 | | 5/2012 | Olson et al. | |
| 8,225,873 | B2 | | 7/2012 | Davis | |
| 8,991,504 | B2 | | 3/2015 | Hanson | |
| 2007/0286746 | A1 | | 12/2007 | Thrasher et al. | |
| 2008/0283250 | A1 | * | 11/2008 | Simmons | E21B 43/121 166/369 |
| 2011/0036581 | A1 | | 2/2011 | Davidson | |
| 2011/0278015 | A1 | * | 11/2011 | Mazzanti | E21B 17/18 166/372 |
| 2011/0308812 | A1 | * | 12/2011 | Bullen | E21B 43/129 166/372 |
| 2012/0125625 | A1 | * | 5/2012 | Brewer | E21B 43/122 166/372 |

FOREIGN PATENT DOCUMENTS

| | | |
|---|---|---|
| CA | 2200665 | 7/2001 |
| CN | 201078220 | 6/2008 |
| CN | 101538999 | 9/2009 |
| CN | 101842546 | 9/2010 |
| CN | 102102506 | 6/2011 |
| WO | WO 9825005 | 6/1998 |

* cited by examiner

DOWNHOLE PUMPING APPARATUS AND METHOD

TECHNICAL FIELD

An apparatus and a method for moving fluids in a wellbore.

BACKGROUND OF THE INVENTION

The removal of liquids which accumulate in producing wells is required in order to enhance production from the well and the overall operation of the production system. In particular, liquids removal is necessary for the dewatering of gas wells and the removal of oil from wells where mixed oil and gas exists in the underground reservoir. If the liquids, such as water and/or oil, are not removed, the liquids tend to accumulate and fill or load up the well, which restricts the flow of the gas to the surface. Eventually, the liquids may choke off gas production completely. Therefore, a problem to be overcome is to remove the liquids continually to avoid their accumulation in the well.

One approach to this problem is to use a gas lift system which uses the natural gas pressure in the reservoir to lift the liquids from the well. In a gas lift system, a tubing string is typically located in the well which extends from the surface into the accumulated liquids such that the accumulated liquids may flow into the tubing string. The gas then enters the tubing string from the underground reservoir at chosen intervals along the tubing string to cause the liquids within the tubing string to rise to the surface. A freely moveable plunger or pig may be located in the tubing string to minimize the penetration of the gas through the liquids. Where the gas lift system uses the pressurized gas from the reservoir to transport slugs of the liquid to the surface, a small diameter tubing string for producing the liquids is often required so that the gas pressure and the gas velocity are sufficient to carry the liquids to the surface. However, the requirement for small diameter tubing may significantly restrict the flow of the liquids and reduce the gas production. As well, the produced gas and liquids are typically well mixed at the surface, which may cause problems in surface production lines, such as hydrate formation or freezing. Further, gas lift systems have been found to be unsuitable where the downhole gas pressure or the gas velocity is low and thus, the gas is unable to overcome the pressure head of the liquids to carry the liquids to the surface.

Other gas lift systems have been designed which only periodically or intermittently lift the liquids to the surface in a cyclical operation in order to allow the natural gas pressure to develop in the well between the cycles to a critical level necessary to lift the liquids. Examples of such systems are described in U.S. Pat. No. 2,136,229 (Baldwin et al), U.S. Pat. No. 4,596,516 (Scott et al) and U.S. Pat. No. 4,465,435 (Copas). Some of these systems use a timer operated valve, located in the outlet of the tubing containing the liquids. The valve is set to periodically open at a timed interval equal to the time required for the natural gas pressure in the well to recover following the release of such pressure. Other systems use valves sensitive to a predetermined differential pressure between the liquids in the tubing string and the gas to control the periodic opening of the valve to allow lifting of the liquids by the gas.

Other gas lift systems introduce pressurized fluid into the well from an outside source in addition to the natural gas from the reservoir, as shown in U.S. Pat. No. 2,132,738 (Knox), U.S. Pat. No. 6,322,333 (Knight), U.S. Pat. No. 7,546,870 (Dotson), and U.S. Pat. No. 7,566,208 (Santos). However, the introduction of the pressurized fluid into the well to lift the liquids requires the use of a compressor which tends to increase both the cost and complexity of the production apparatus required.

A further approach to the problem of liquid loading is shown in Canadian Patent No. 1,167,760 (Prather) which describes a reciprocating surface pump which is powered by the natural gas pressure from the reservoir. The reciprocating surface pump is connected to a string of sucker rods which are connected to a conventional downhole pump. In essence, the gas from the well is conducted to the surface where it drives the reciprocating surface pump. The reciprocating pump then powers the downhole pump, which pumps the liquids to the surface. Several disadvantages are exhibited by this system. First, the system requires a reciprocating pump at the surface. Second, as the gas is conducted to the surface for powering the reciprocating pump, the reciprocating pump must be designed as a pressure vessel which is able to withstand the pressure differential between the atmosphere and the downhole pressure. Third, there will be some energy loss as the gas travels from the bottom of the well to the reciprocating pump on the surface. Fourth, reciprocation of the sucker rods within the tubing string results in wearing of the tubing string and energy loss due to friction between the sucker rods and the tubing string.

Other systems for removing liquids from producing wells are described in U.S. Pat. No. 5,860,795 (Ridley et al), U.S. Pat. No. 6,234,770 (Ridley et al), U.S. Pat. No. 7,204,314 (Lauritzen et al) and U.S. Pat. No. 7,789,142 (Dotson).

There continues to be a need for apparatus and methods for moving fluids through a wellbore which make use of the gas pressure present within the wellbore. Further, there continues to be a need for such apparatus which can be inserted in the wellbore and contained in the wellbore during their operation.

SUMMARY OF THE INVENTION

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

As used herein, "proximal" means located relatively toward an intended "uphole" end, "upper" end and/or "surface" end of a wellbore. As used herein, "above" means relatively proximal.

As used herein, "distal" means located relatively away from an intended "uphole" end, "upper" end and/or "surface" end of a wellbore. As used herein, "below" means relatively distal.

As used herein, "fluid" includes a liquid, a gas and/or a combination of liquids and/or gases, including a multiphase fluid, which may also contain a small amount of solid material.

The present invention relates to an apparatus and a method for moving fluids in a wellbore using a gas pressure of a gas phase which is contained in the wellbore. The present invention includes features which may be adapted for use with the inventions described in U.S. Pat. No. 5,860,795 (Ridley et al) and U.S. Pat. No. 6,234,770 (Ridley et al). Alternatively, the inventions described in U.S. Pat. No.

5,860,795 (Ridley et al) and U.S. Pat. No. 6,234,770 (Ridley et al) may be adapted for use with features of the present invention.

The apparatus of the invention is configured to be inserted in a wellbore. The apparatus has a proximal end and a distal end.

In some embodiments, the apparatus may be comprised of a sealing device which is adapted for sealing the wellbore in order to provide an upper wellbore section and a lower wellbore section, a first pump for pumping liquids from the lower wellbore section, a pump drive for driving the first pump, wherein the pump drive is powered by a lower wellbore gas pressure of a lower wellbore gas phase which is contained in the lower wellbore section, a gas inlet in communication with the lower wellbore section for receiving the lower wellbore gas phase in order to supply the gas phase to the pump drive, and a gas outlet in communication with the upper wellbore section for exhausting the lower wellbore gas phase from the pump drive into the upper wellbore section.

The apparatus of the invention may be adapted to be inserted in a wellbore in any suitable manner. In some embodiments, components of the apparatus may be axially spaced along the length of the apparatus between the proximal end and the distal end so that the components are arranged end-to-end along the apparatus. In some embodiments, components of the apparatus may be located at a single axial position along the length of the apparatus between the proximal end and the distal end so that the components are arranged side-by-side along the apparatus. In some embodiments, components of the apparatus may be configured as a combination of end-to-end and side-by-side arrangements along the length of the apparatus between the proximal end and the distal end. A consideration in configuring the components of the apparatus is the diameter of the wellbore into which the apparatus will be inserted.

The apparatus of the invention may be inserted in a wellbore in any suitable manner. In some embodiments, the apparatus may be lowered into a wellbore on a pipe string, on coiled tubing, on a wireline or on a slickline.

In some embodiments, the sealing device may be located axially between the proximal end and the distal end of the apparatus so that the proximal end will be positioned in the upper wellbore section and so that the distal end will be positioned in the lower wellbore section.

The sealing device may be comprised of any suitable structure, device or apparatus. In some embodiments, the sealing device may be comprised of a packer. The packer may be actuated in any suitable manner. In some embodiments, the packer may be an inflatable packer. In some embodiments, the packer may be a mechanically actuated packer. In some embodiments, a mechanically actuated packer may be actuated by manipulation of a pipe string or coiled tubing to which the apparatus is attached.

In some embodiments, the first pump may be a reciprocating pump and the pump drive may be a reciprocating pump drive. In some embodiments, the first pump may be a rotary pump and the pump drive may be a rotary pump drive. Some features of the invention may be suitable for use with both reciprocating and rotary pumps and pump drives. Some features of the invention may be more suitable for use with reciprocating pumps and pump drives, or may be more suitable for use with rotary pumps and pump drives.

In some embodiments, the first pump may be similar in structure to embodiments of the first pump which are described in U.S. Pat. No. 5,860,795 (Ridley et al) and U.S. Pat. No. 6,234,770 (Ridley et al). In some embodiments, the pump drive may be similar in structure to embodiments of the pump drive which are described in U.S. Pat. No. 5,860,795 (Ridley et al) and U.S. Pat. No. 6,234,770 (Ridley et al).

In some embodiments, the first pump and the pump drive may be axially spaced along the length of the apparatus between the proximal end and the distal end. In some embodiments, the first pump may be located axially between the pump drive and the distal end.

The first pump has a first pump inlet. In some embodiments, the first pump inlet may communicate with the lower wellbore section. In some embodiments, a first pump inlet line may connect the first pump with the first pump inlet. The first pump has a first pump outlet. In some embodiments, the first pump outlet may communicate with the upper wellbore section. In some embodiments, a first pump outlet line may connect the first pump with the first pump outlet. In some embodiments, the first pump inlet may be adjacent to the distal end of the apparatus. In some embodiments, the first pump outlet may be adjacent to the proximal end of the apparatus. In some embodiments, the first pump inlet line may extend axially through the apparatus between the first pump and the first pump inlet. In some embodiments, the first pump outlet line may extend axially through the apparatus between the first pump and the first pump outlet.

In some embodiments, the apparatus may be further comprised of a first pump outlet check valve which is positioned in the first pump outlet line adjacent to the first pump outlet, for preventing fluids from passing from the upper wellbore section through the first pump outlet line.

In some embodiments, the apparatus may be further comprised of a pressure relief device positioned in the first pump outlet line between the first pump outlet and the first pump outlet check valve. In some embodiments, the pressure relief device may be comprised of a pressure relief valve or a burst disc.

The gas inlet may be comprised of any suitable opening or combination of openings in the apparatus which is suitable for enabling the lower wellbore gas phase to enter the apparatus.

The gas outlet may be comprised of any suitable opening or combination of openings in the apparatus which is suitable for enabling the lower wellbore gas phase to be exhausted into the upper wellbore section.

In some embodiments, the apparatus of the invention may be further comprised of a second pump for pumping fluids from the upper wellbore section into the lower wellbore section. The second pump may be driven by the pump drive. In some embodiments, the second pump may be similar in structure to embodiments of the second pump which are described in U.S. Pat. No. 5,860,795 (Ridley et al) and U.S. Pat. No. 6,234,770 (Ridley et al).

In some embodiments, the first pump, the second pump and the pump drive may be axially spaced along the length of the apparatus between the proximal end and the distal end.

In some embodiments, the second pump may be located axially between the pump drive and the distal end. In some embodiments, the second pump may be located axially between the pump drive and the distal end. In some embodiments, the second pump may be located axially between the pump drive and the first pump.

The second pump has a second pump inlet. In some embodiments, the second pump inlet may communicate with the upper wellbore section. In some embodiments, a second pump inlet line may connect the second pump with the second pump inlet. The second pump has a second pump outlet. In some embodiments, the second pump outlet may communicate with the lower wellbore section. In some embodiments, a second pump outlet line may connect the second pump with the second pump outlet. In some embodiments, the second pump inlet may be adjacent to the proximal end of the apparatus. In some embodiments, the second pump outlet may be adjacent to the distal end of the apparatus. In some embodiments, the second pump inlet line may extend axially through the apparatus between the second pump inlet and the second pump. In some embodiments, the second pump outlet line may extend axially through the apparatus between the second pump and the second pump outlet.

In some embodiments, the second pump may be adapted to be driven directly by the lower wellbore gas phase in addition to being driven by the pump drive.

In some embodiments, the apparatus of the invention may be further comprised of a vent for venting to the upper wellbore section a vented portion of the lower wellbore gas phase which is contained in the lower wellbore section so that the vented portion of the lower wellbore gas phase bypasses the pump drive.

In some embodiments, the vent may be associated with the gas inlet so that the vented portion of the lower wellbore gas phase is a portion of the lower wellbore gas phase which is received at the gas inlet. In some embodiments, the vent may be associated with the gas outlet so that the vented portion of the lower wellbore gas phase is vented through the gas outlet.

In some embodiments, the apparatus may be further comprised of a vent valve associated with the vent. In some embodiments, the vent valve may be configured so that the vent is open when the lower wellbore gas pressure is above a threshold gas pressure and so that the vent is closed when the lower wellbore gas pressure is below the threshold gas pressure. The vent valve may be configured to open and close in any suitable manner. In some embodiments, the vent valve may be configured to open and close automatically in response to the lower wellbore gas pressure. In some embodiments, the vent valve may be configured to open and close manually and/or in response to a command provided by a person or controller.

In some embodiments, the pump drive may be a reciprocating pump drive.

If the pump drive is a reciprocating pump drive, the apparatus of the invention may be further comprised of a switch for alternately directing the lower wellbore gas phase to opposite sides of the pump drive in order to reciprocate the pump drive.

In some embodiments, the switch may be comprised of a reciprocating switch valve for directing the lower wellbore gas phase to opposite sides of the pump drive and a reciprocating control valve for controlling the switch valve. The control valve may use a control portion of the lower wellbore gas phase which is received at the gas inlet to reciprocate the switch valve. The apparatus may be further comprised of a control line for delivering the control portion of the lower wellbore gas phase to the control valve. The control line may be configured so that the lower wellbore gas phase is received at the gas inlet and is delivered to the switch valve and to the control valve in parallel.

In some embodiments, the switch valve may be comprised of a plurality of switch valve pistons and a switch valve linkage connecting the switch valve pistons so that the switch valve pistons reciprocate together. The control portion of the lower wellbore gas phase may be alternately directed to opposite sides of all of the switch valve pistons by the control valve in order to reciprocate the switch valve.

In some embodiments, the method of the invention may be comprised of sealing a wellbore in order to provide an upper wellbore section and a lower wellbore section, supplying a lower wellbore gas phase which is contained in the lower wellbore section to a pump drive in order to power the pump drive, and driving a first pump with the pump drive in order to pump fluids from the lower wellbore section.

In some embodiments, the method of the invention may be further comprised of driving a second pump with the pump drive in order to pump fluids from the upper wellbore section into the lower wellbore section.

In some embodiments, the method of the invention may be further comprised of venting to the upper wellbore section a vented portion of the lower wellbore gas phase so that the vented portion of the lower wellbore gas phase bypasses the pump drive. In some embodiments, the venting may occur when the lower wellbore gas pressure is above a threshold gas pressure.

Exemplary aspects of the apparatus and method of the invention may be directed at one or more features of the invention.

In a first exemplary apparatus aspect, the invention is an apparatus for insertion in a wellbore in order to move fluids in the wellbore, wherein the wellbore communicates with an underground reservoir containing reservoir fluids such that the reservoir fluids enter the wellbore, wherein the reservoir fluids are comprised of a gas phase, and wherein the apparatus comprises:

(a) a sealing device adapted for sealing the wellbore in order to provide an upper wellbore section proximal to the sealing device and a lower wellbore section distal to the sealing device, so that a lower wellbore gas phase which is contained in the lower wellbore section is maintained at a lower wellbore gas pressure;
(b) a first pump for pumping fluids from the lower wellbore section;
(c) a second pump for pumping fluids from the upper wellbore section into the lower wellbore section;
(d) a pump drive operably connected to the first pump and the second pump, for driving the first pump and the second pump, wherein the pump drive is adapted to be powered using the lower wellbore gas pressure of the lower wellbore gas phase;
(e) a gas inlet in communication with the lower wellbore section, for receiving the lower wellbore gas phase from the lower wellbore section in order to supply the lower wellbore gas phase to the pump drive; and
(f) a gas outlet in communication with the upper wellbore section, for exhausting the lower wellbore gas phase from the pump drive into the upper wellbore section.

In a second exemplary apparatus aspect, the invention is an apparatus for insertion in a wellbore in order to move fluids in the wellbore, wherein the wellbore communicates with an underground reservoir containing reservoir fluids such that the reservoir fluids enter the wellbore, wherein the reservoir fluids are comprised of a gas phase, and wherein the apparatus comprises:

(a) a sealing device adapted for sealing the wellbore in order to provide an upper wellbore section proximal to the sealing device and a lower wellbore section distal to the sealing device, so that a lower wellbore gas phase which is contained in the lower wellbore section is maintained at a lower wellbore gas pressure;
(b) a first pump for pumping fluids from the lower wellbore section;
(c) a pump drive operably connected to the first pump, for driving the first pump, wherein the pump drive is adapted to be powered using the lower wellbore gas pressure of the lower wellbore gas phase;

(d) a gas inlet in communication with the lower wellbore section, for receiving the lower wellbore gas phase from the lower wellbore section in order to supply the lower wellbore gas phase to the pump drive;

(e) a gas outlet in communication with the upper wellbore section, for exhausting the lower wellbore gas phase from the pump drive into the upper wellbore section; and (f) a vent for venting to the upper wellbore section a vented portion of the lower wellbore gas phase so that the vented portion of the lower wellbore gas phase bypasses the pump drive.

In a third exemplary apparatus aspect, the invention is an apparatus for insertion in a wellbore in order to move fluids in the wellbore, wherein the wellbore communicates with an underground reservoir containing reservoir fluids such that the reservoir fluids enter the wellbore, wherein the reservoir fluids are comprised of a gas phase, and wherein the apparatus comprises:

(a) a sealing device adapted for sealing the wellbore in order to provide an upper wellbore section proximal to the sealing device and a lower wellbore section distal to the sealing device, so that a lower wellbore gas phase which is contained in the lower wellbore section is maintained at a lower wellbore gas pressure;

(b) a reciprocating first pump for pumping fluids from the lower wellbore section;

(c) a reciprocating pump drive operably connected to the first pump, for driving the first pump, wherein the pump drive is adapted to be powered using the lower wellbore gas pressure of the lower wellbore gas phase;

(d) a gas inlet in communication with the lower wellbore section, for receiving the lower wellbore gas phase from the lower wellbore section in order to supply the lower wellbore gas phase to the pump drive;

(e) a gas outlet in communication with the upper wellbore section, for exhausting the lower wellbore gas phase from the pump drive into the upper wellbore section; and (f) a switch for alternately directing the lower wellbore gas phase received at the gas inlet to opposite sides of the pump drive in order to reciprocate the pump drive, wherein the switch is comprised of:

(i) a reciprocating switch valve, wherein the switch valve reciprocates between a first switch valve position in which the lower wellbore gas phase is directed to a first side of the pump drive and a second switch valve position in which the lower wellbore gas phase is directed to a second side of the pump drive;

(ii) a reciprocating control valve, wherein the control valve is reciprocated by the pump drive between a first control valve position in which a control portion of the lower wellbore gas phase which is received at the gas inlet is directed to a first side of the switch valve in order to reciprocate the switch valve to the first switch valve position and a second control valve position in which the control portion of the lower wellbore gas phase is directed to a second side of the switch valve in order to reciprocate the switch valve to the second switch valve position; and (iii) a control line for delivering the control portion of the lower wellbore gas phase to the control valve, wherein the control line is configured so that the lower wellbore gas phase is received at the gas inlet and is delivered to the switch valve and to the control valve in parallel.

In a fourth exemplary apparatus aspect, the invention is an apparatus for insertion in a wellbore in order to move fluids in the wellbore, wherein the wellbore communicates with an underground reservoir containing reservoir fluids such that the reservoir fluids enter the wellbore, wherein the reservoir fluids are comprised of a gas phase, and wherein the apparatus comprises:

(a) a sealing device adapted for sealing the wellbore in order to provide an upper wellbore section proximal to the sealing device and a lower wellbore section distal to the sealing device, so that a lower wellbore gas phase which is contained in the lower wellbore section is maintained at a lower wellbore gas pressure;

(b) a reciprocating first pump for pumping fluids from the lower wellbore section;

(c) a reciprocating pump drive operably connected to the first pump, for driving the first pump, wherein the pump drive is adapted to be powered using the lower wellbore gas pressure of the lower wellbore gas phase;

(d) a gas inlet in communication with the lower wellbore section, for receiving the lower wellbore gas phase from the lower wellbore section in order to supply the lower wellbore gas phase to the pump drive;

(e) a gas outlet in communication with the upper wellbore section, for exhausting the lower wellbore gas phase from the pump drive into the upper wellbore section; and (f) a switch for alternately directing the lower wellbore gas phase received at the gas inlet to opposite sides of the pump drive in order to reciprocate the pump drive, wherein the switch is comprised of:

(i) a reciprocating switch valve, wherein the switch valve reciprocates between a first switch valve position in which the lower wellbore gas phase is directed to a first side of the pump drive and a second switch valve position in which the lower wellbore gas phase is directed to a second side of the pump drive, wherein the switch valve is comprised of a plurality of switch valve pistons and a switch valve linkage connecting the switch valve pistons so that the switch valve pistons reciprocate together; and (ii) a reciprocating control valve, wherein the control valve is reciprocated by the pump drive between a first control valve position in which a control portion of the lower wellbore gas phase is directed to a first side of all of the switch valve pistons in order to reciprocate the switch valve to the first switch valve position and a second control valve position in which the control portion of the lower wellbore gas phase is directed to a second side of all of the switch valve pistons in order to reciprocate the switch valve to the second switch valve position.

These exemplary apparatus aspects of the invention may each further comprise one or more other features of the apparatus of the invention.

In a first exemplary method aspect, the invention is a method for moving fluids in a wellbore, wherein the wellbore communicates with an underground reservoir containing reservoir fluids such that the reservoir fluids enter the wellbore, wherein the reservoir fluids are comprised of a gas phase, and wherein the method comprises:

(a) sealing the wellbore in order to provide an upper wellbore section and a lower wellbore section, so that a lower wellbore gas phase which is contained in the lower wellbore section is maintained at a lower wellbore gas pressure;

(b) supplying the lower wellbore gas phase to a pump drive in order to power the pump drive, wherein the pump drive is adapted to be powered using the lower wellbore gas pressure of the lower wellbore gas phase;

(c) driving a first pump with the pump drive in order to pump fluids from the lower wellbore section; and (d) driving a second pump with the pump drive in order to pump fluids from the upper wellbore section into the lower wellbore section.

In a second exemplary method aspect, the invention is a method for moving fluids in a wellbore, wherein the wellbore communicates with an underground reservoir containing reservoir fluids such that the reservoir fluids enter the wellbore, wherein the reservoir fluids are comprised of a gas phase, and wherein the method comprises:

(a) sealing the wellbore in order to provide an upper wellbore section and a lower wellbore section, so that a lower wellbore gas phase which is contained in the lower wellbore section is maintained at a lower wellbore gas pressure;

(b) supplying the lower wellbore gas phase to a pump drive in order to power the pump drive, wherein the pump drive is adapted to be powered using the lower wellbore gas pressure of the lower wellbore gas phase;

(c) driving a first pump with the pump drive in order to pump fluids from the lower wellbore section; and (d) venting to the upper wellbore section a vented portion of the lower wellbore gas phase so that the vented portion of the lower wellbore gas phase bypasses the pump drive.

These exemplary method aspects of the invention may both further comprise one or more other features of the method of the invention.

BRIEF DESCRIPTION OF DRAWINGS

Embodiments of the invention will now be described with reference to the accompanying drawings, in which:

FIGS. 2A-2D is a schematic longitudinal section assembly drawing of the exemplary embodiment of the apparatus depicted in FIG. 1, wherein FIG. 2B is an extension of FIG. 2A, FIG. 2C is an extension of FIG. 2B, and FIG. 2D is an extension of FIG. 2C, showing the control valve in the first control valve position, showing the switch valve in the first switch valve position, and showing the pump drive at the upper end of the pump drive stroke.

FIGS. 3A-3D is a schematic longitudinal section assembly drawing of the exemplary embodiment of the apparatus depicted in FIG. 1, wherein FIG. 3B is an extension of FIG. 3A, FIG. 3C is an extension of FIG. 3B, and FIG. 3D is an extension of FIG. 3C, showing the control valve in the second control valve position, showing the switch valve in the second switch valve position, and showing the pump drive at the lower end of the pump drive stroke.

DETAILED DESCRIPTION

Figure 1:
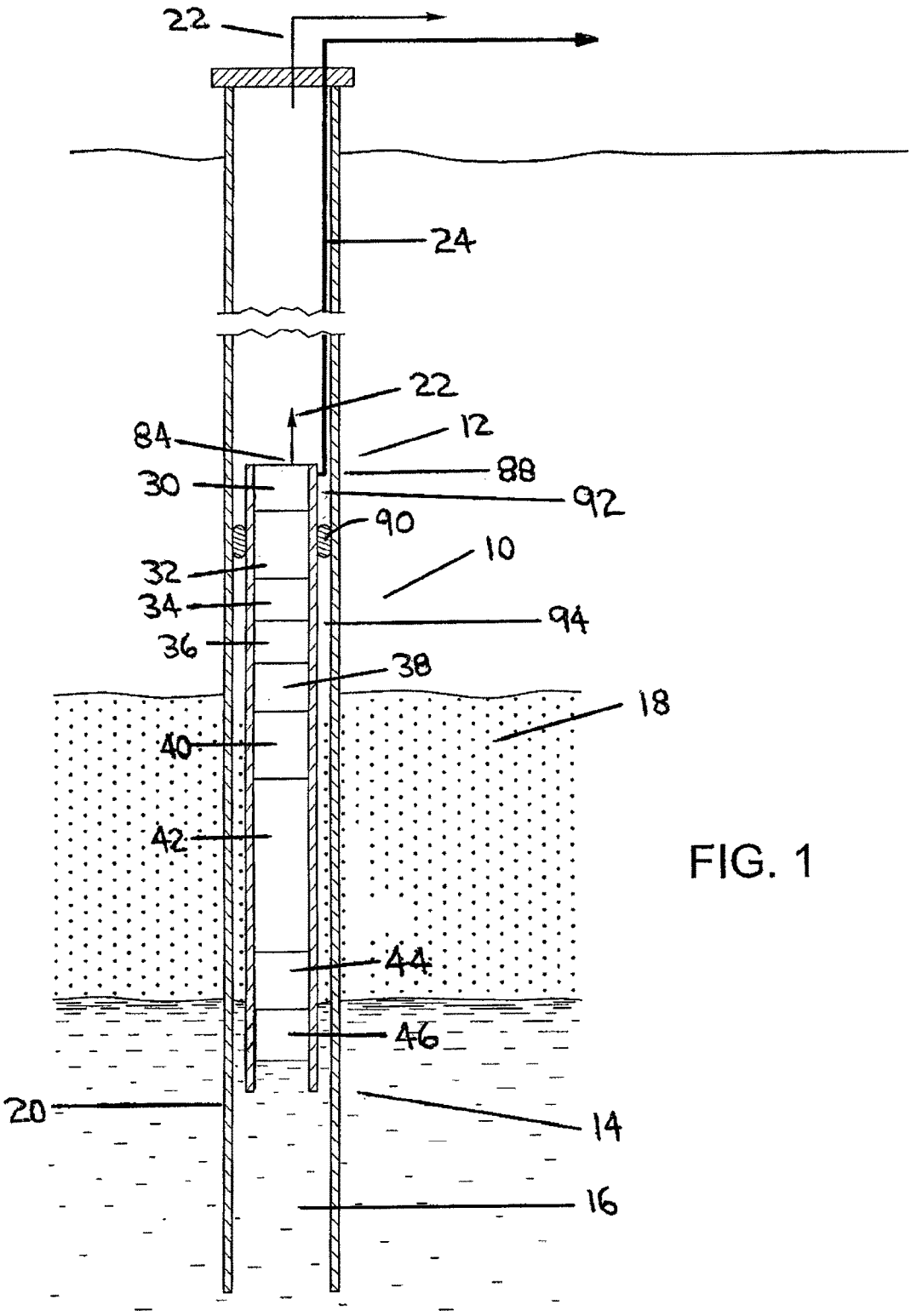
FIG. 1 is a schematic drawing depicting an exemplary embodiment of the apparatus of the invention positioned in a wellbore.
Figure 2A:
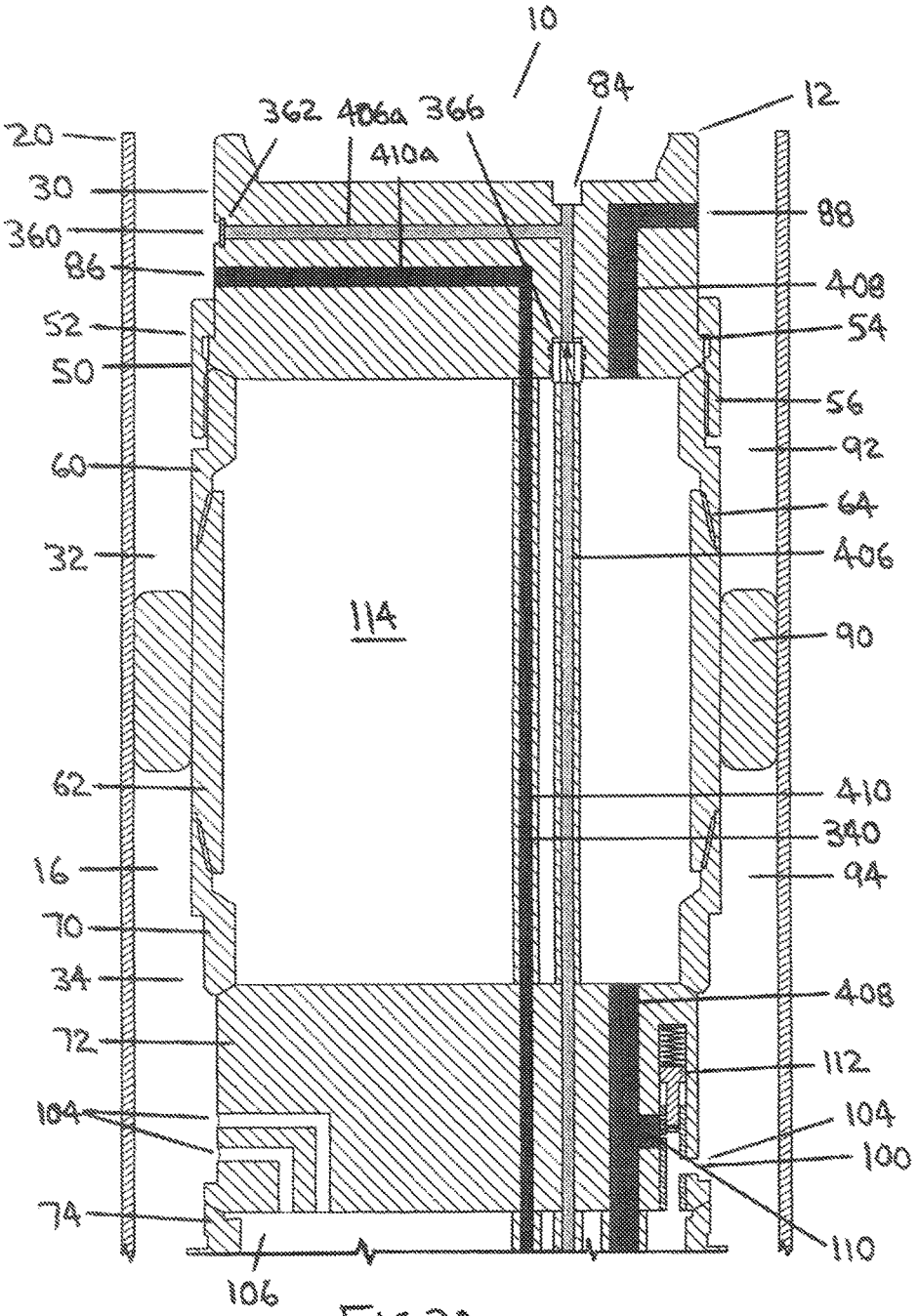
Figure 2B:
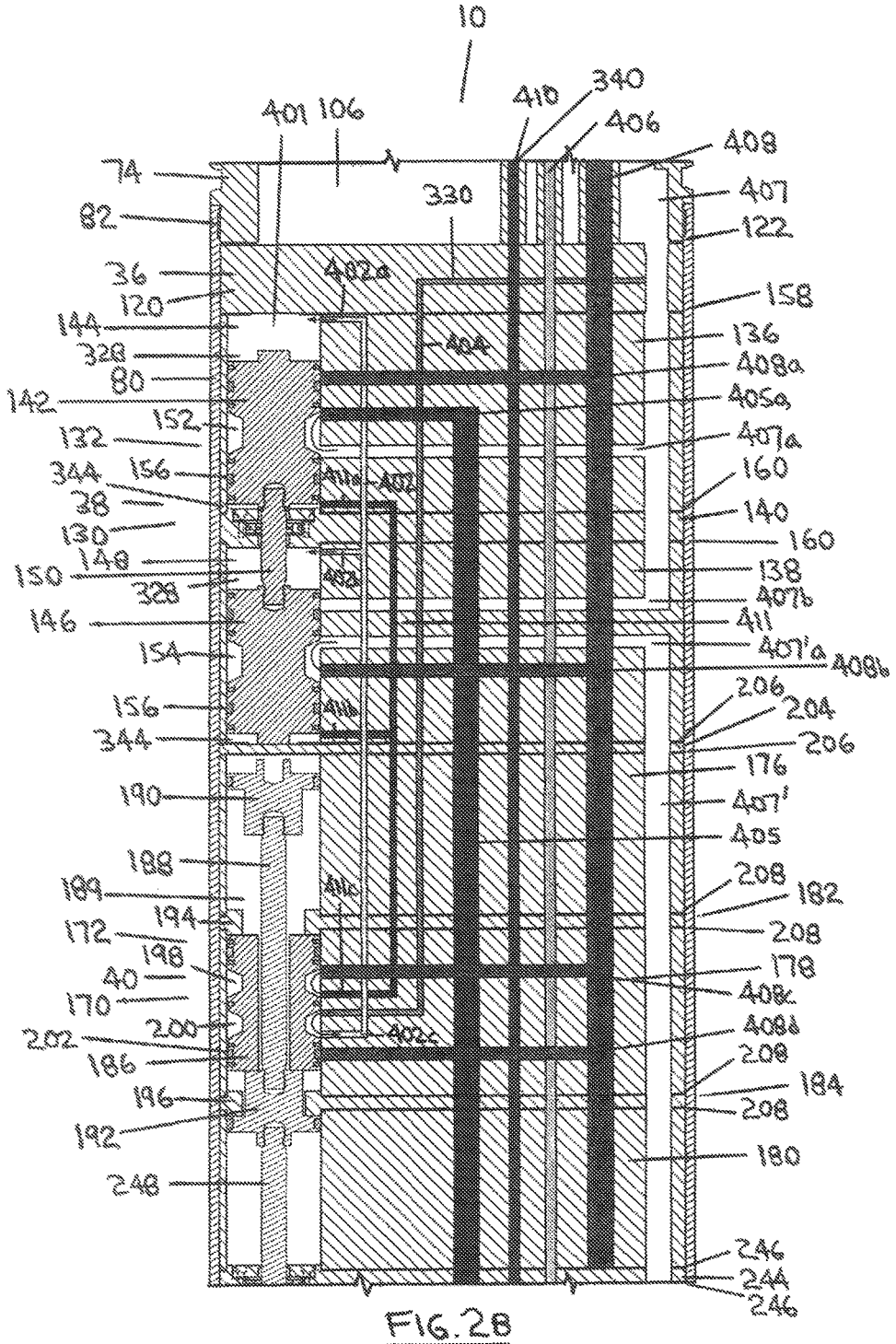
Figure 2C:
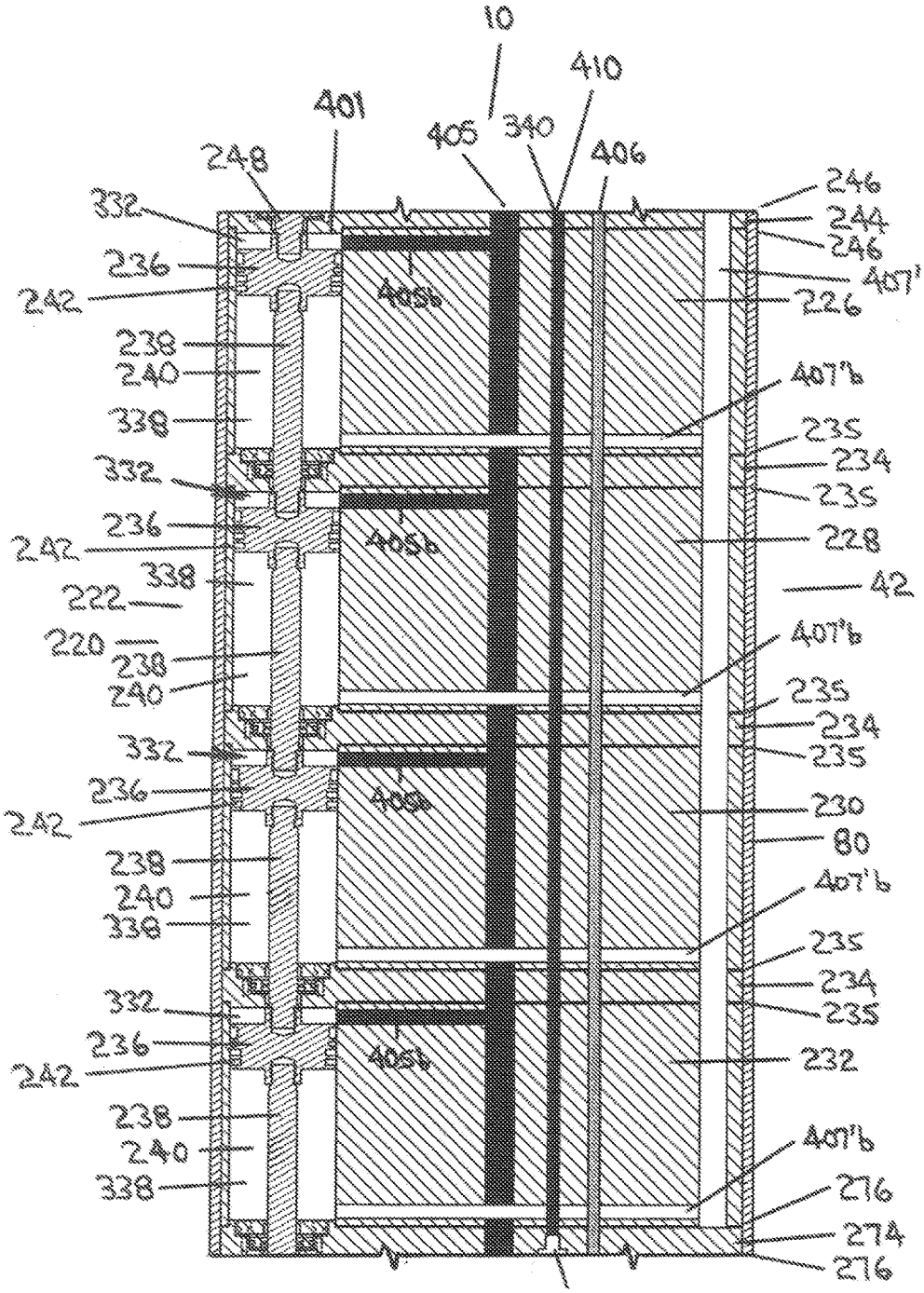
Figure 2D:
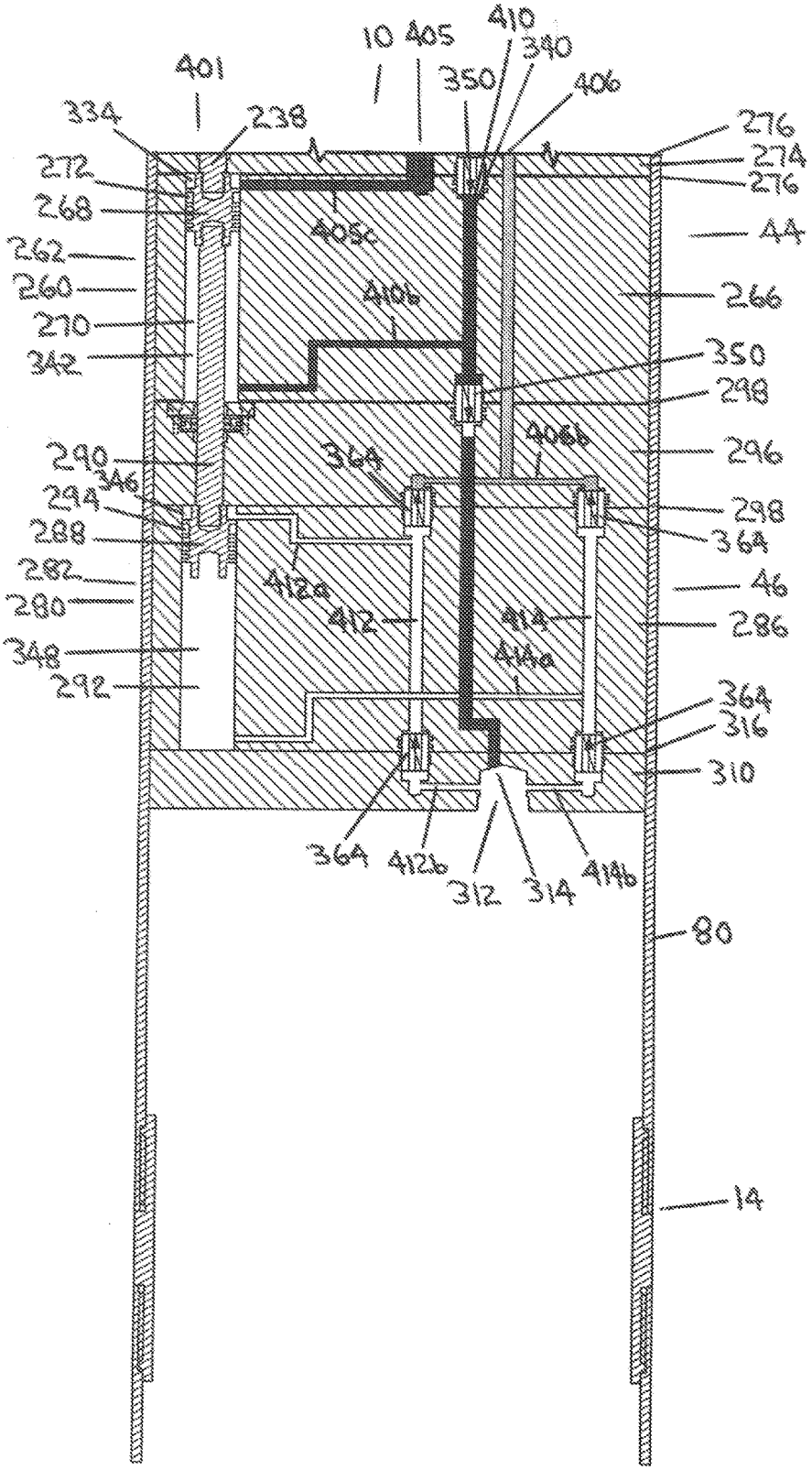
Figure 3A:
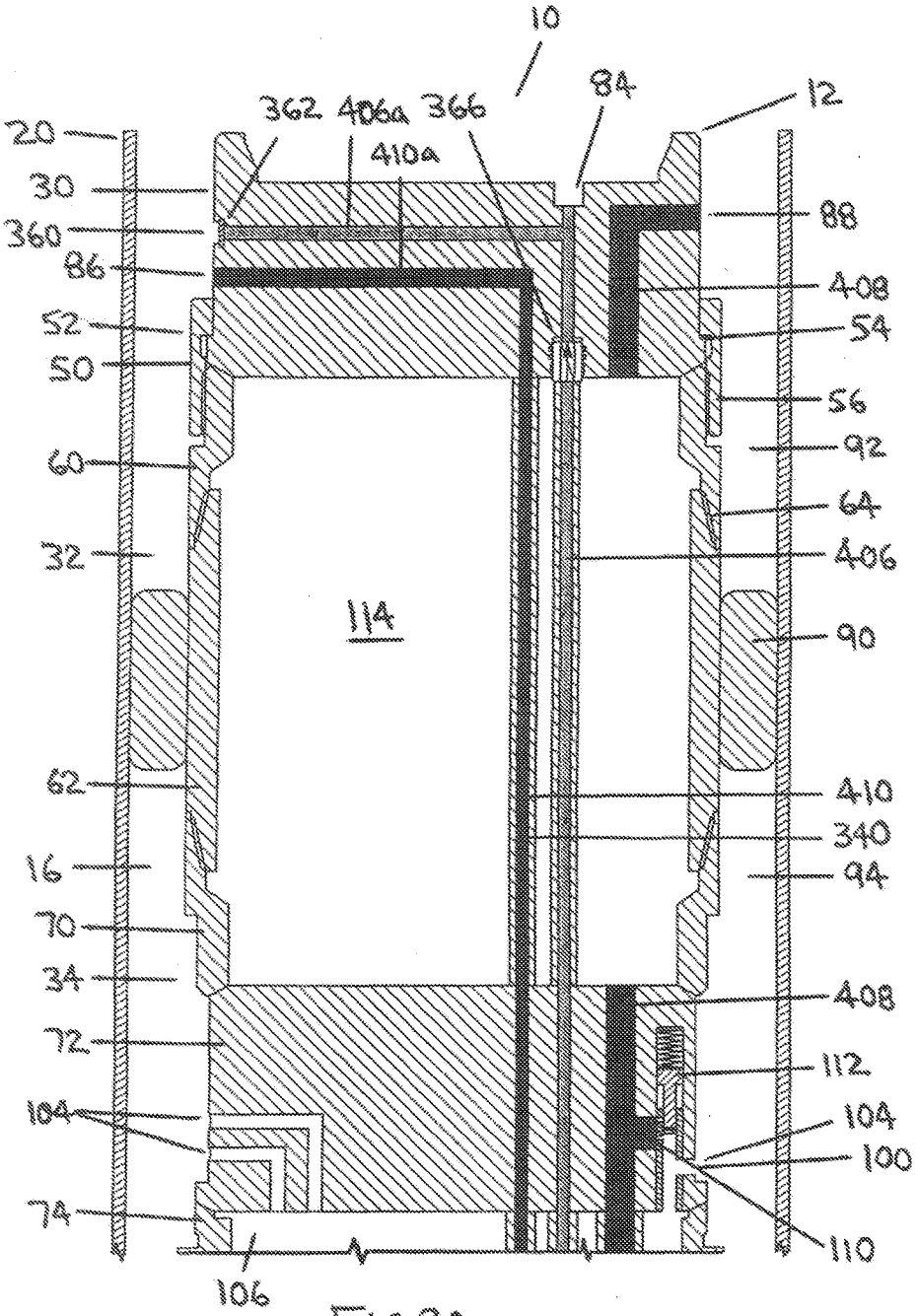
Figure 3B:
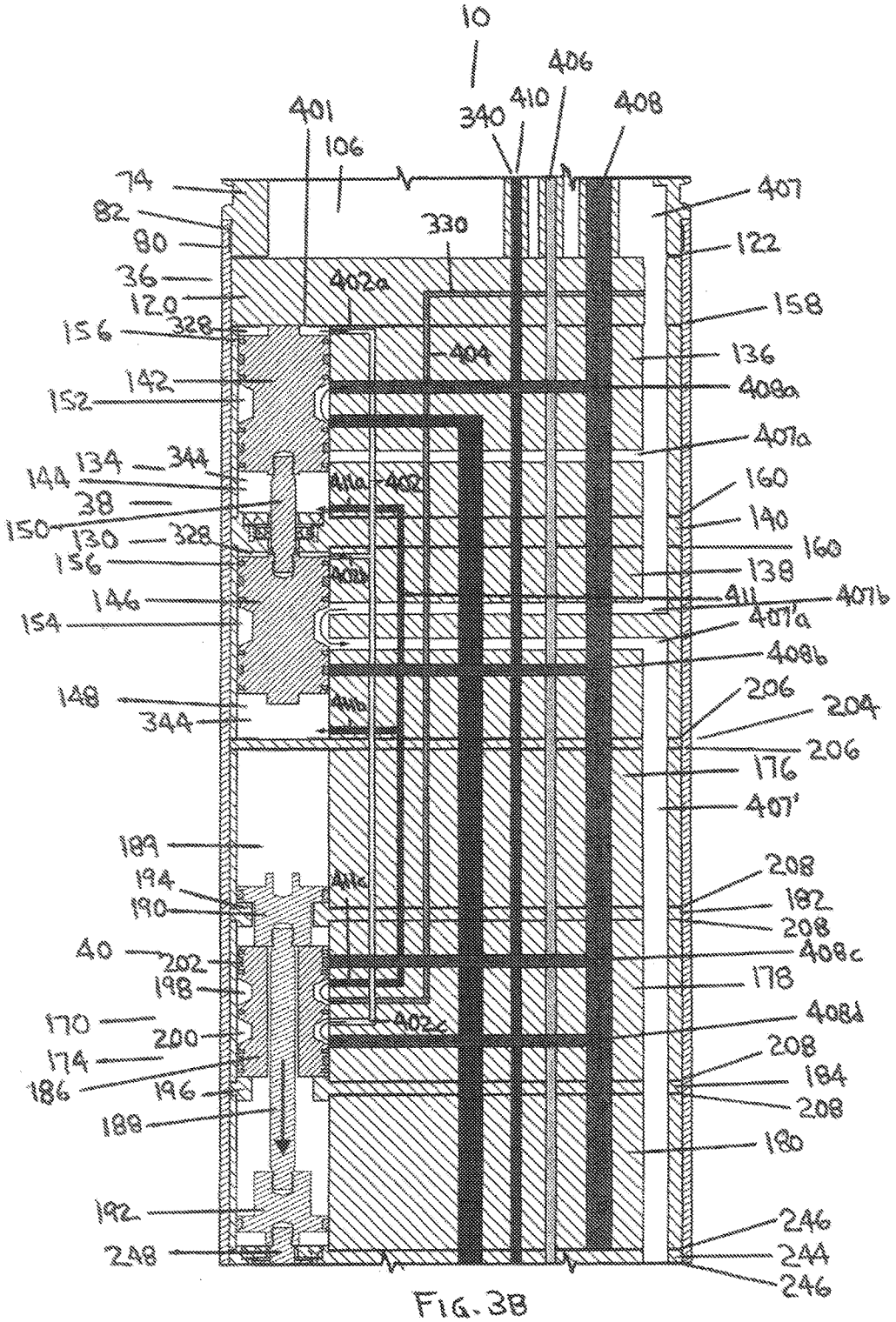
Figure 3C:
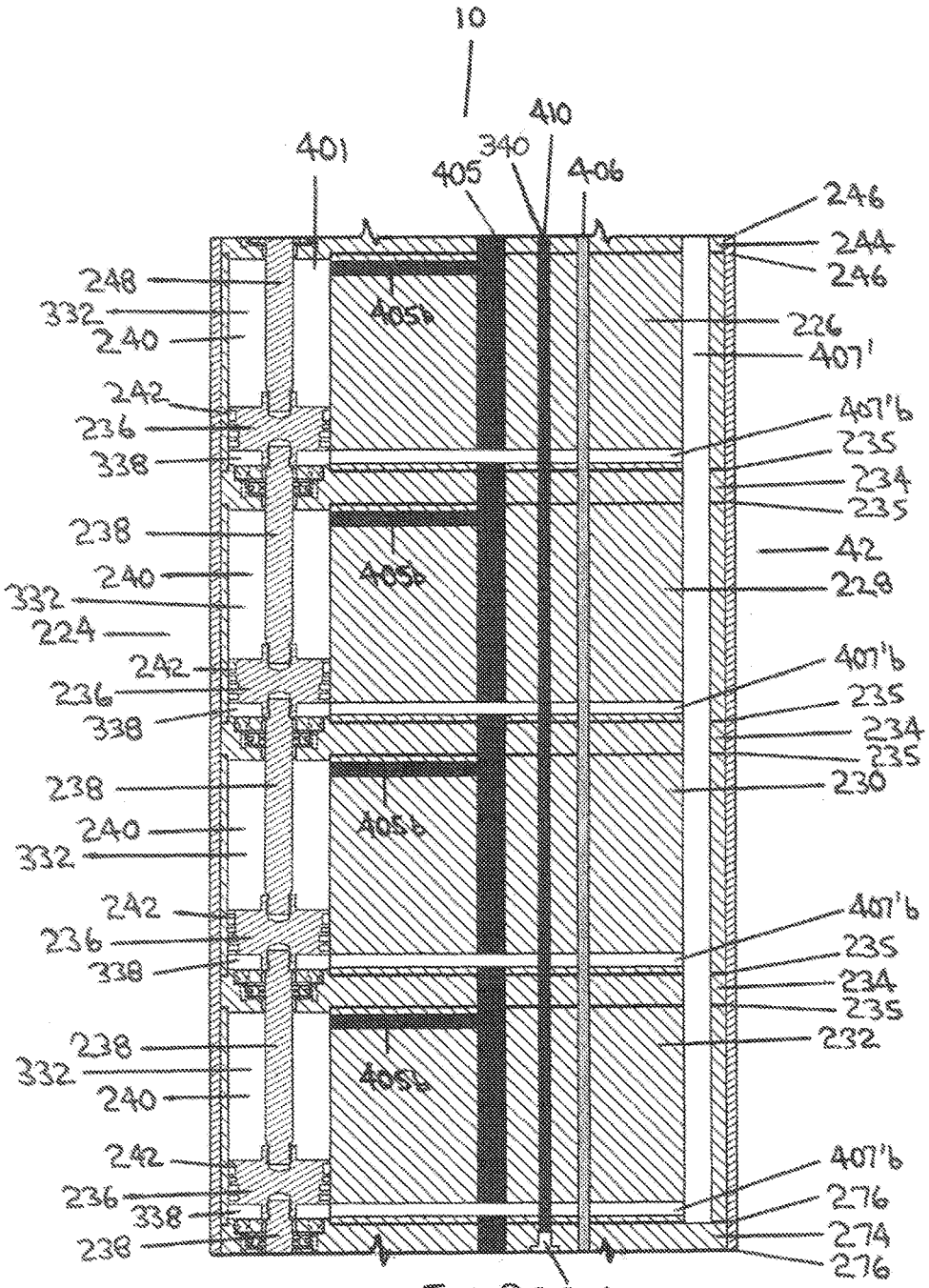
Figure 3D:
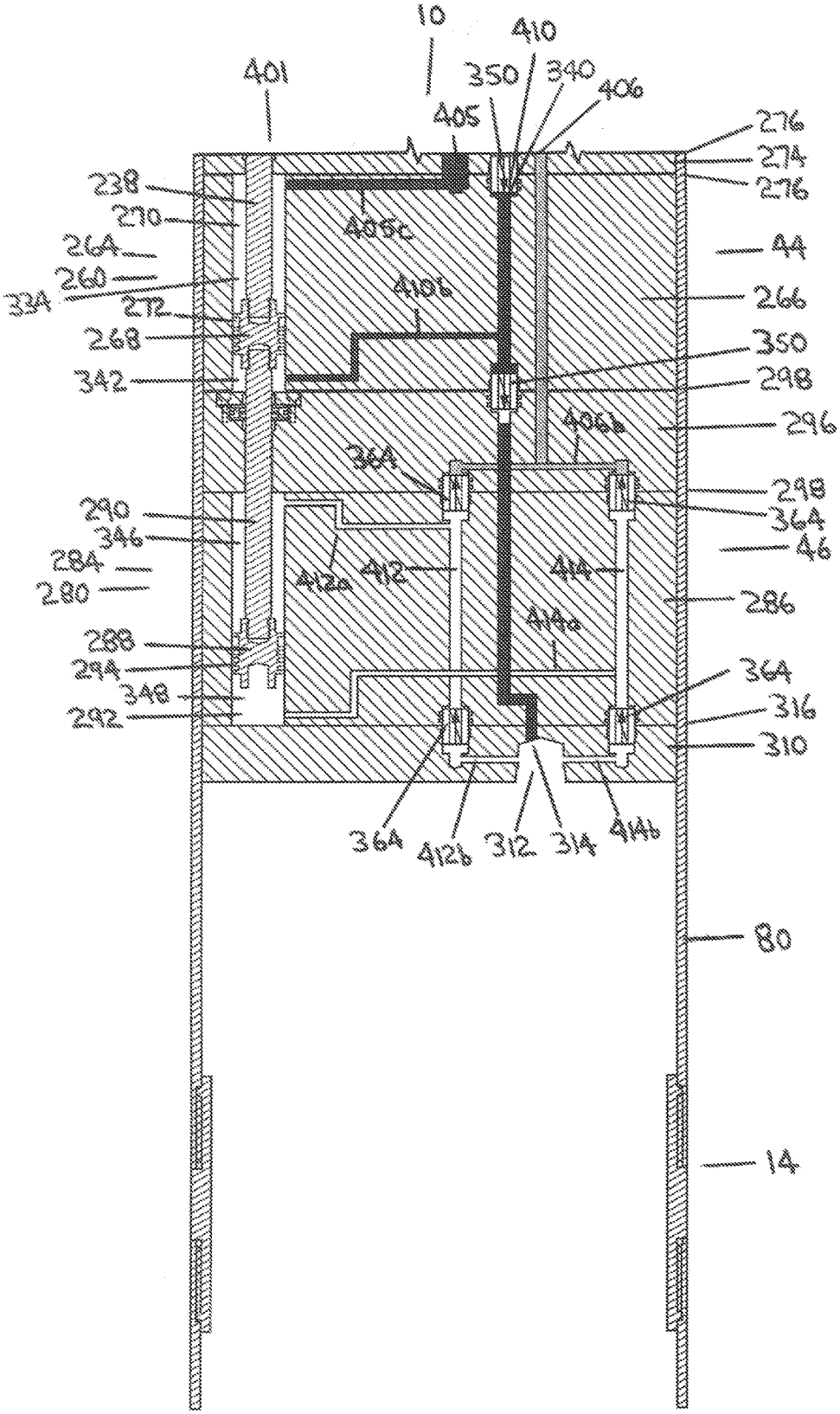

An exemplary embodiment of the apparatus of the invention is depicted in FIGS. 1-3.

FIG. 1 is a schematic drawing depicting the exemplary embodiment positioned in a wellbore. FIG. 2 is a schematic longitudinal section assembly drawing of the exemplary embodiment, showing the control valve in the first control valve position, showing the switch valve in the first switch valve position, and showing the pump drive at the upper end of the pump drive stroke. FIG. 3 is a schematic longitudinal section assembly drawing of the exemplary embodiment, showing the control valve in the second control valve position, showing the switch valve in the second switch valve position, and showing the pump drive at the upper end of the pump drive stroke.

Referring to FIG. 1, the exemplary embodiment of the apparatus (10) has a proximal end (12) and a distal end (14). In the exemplary embodiment, the apparatus (10) is comprised of a plurality of components which are axially spaced along the length of the apparatus (10) between the proximal end (12) and the distal end (14) so that the components are arranged end-to-end along the apparatus (10).

Referring to FIG. 1, the apparatus (10) is depicted positioned in a wellbore (16) in an exemplary configuration for use of the apparatus (10). In the exemplary configuration, the wellbore (16) extends into or through an underground reservoir (18) containing reservoir fluids (not shown). The reservoir fluids are typically comprised of a gas phase (such as natural gas) and at least one liquid phase (such as hydrocarbons and/or water).

In the exemplary configuration, the wellbore (16) is lined with a production casing (20) which is perforated adjacent to the reservoir (18) so that the wellbore (16) communicates with the reservoir (18) and so that the reservoir fluids can enter the wellbore (16). In FIG. 1, the casing (20) is shown extending for the entire length of the wellbore (16). In FIGS. 2-3, for clarity in depicting the apparatus (10), the casing (20) is shown extending only for a portion of the length of the wellbore (16).

In the exemplary configuration, the apparatus (10) may be used to produce a liquid and/or a gas from the wellbore (16). As a result, FIG. 1 depicts schematically a liquid line (22) and a gas line (24) which extend from adjacent to the proximal end (12) of the apparatus (10) toward a ground surface end of the wellbore (16). In the exemplary configuration, the liquid line (22) may be comprised of a production tubing (not shown) and the gas line (24) may be comprised of an annular space or annulus between the casing (20) and the production tubing.

In the exemplary embodiment, from the proximal end (12) to the distal end (14) of the apparatus (10), the components include a packer transition sub (30), a packer sub (32), a vent valve sub (34), a crossover spacer sub (36), a switch valve sub (38), a control valve sub (40), a pump drive sub (42), a second pump sub (44), and a first pump sub (46).

In other embodiments, additional components, including but not limited to spacer subs (not shown) may be included in the apparatus (10) to provide a desired axial distance between components of the apparatus (10). As a non-limiting example, one or more spacer subs may be included to provide a desired axial distance between the packer sub (32) and the pump subs (44, 46).

Referring to FIGS. 2-3, in the exemplary embodiment, the packer transition sub (30) is connected with the packer sub (32) with a collar (50). A proximal end of the collar (50) is comprised of an inwardly projecting flange (52) which engages a shoulder (54) on the packer transition sub (30). A distal end of the collar (50) is provided with internal threads which engage with external threads on a proximal end of the packer sub (32) to provide a threaded connection (56) between the collar (50) and the packer sub (32).

Referring to FIGS. 2-3, in the exemplary embodiment, the packer sub (32) is comprised of a proximal packer sub (60) and a main packer sub (62). The proximal packer sub (60) is connected with the main packer sub (62) by a threaded connection (64). A distal end of the main packer sub (62) is provided with external threads.

Referring to FIGS. 2-3, in the exemplary embodiment, the vent valve sub (34) is comprised of a proximal vent valve sub (70), a main vent valve sub (72), and a distal vent valve sub (74). In the exemplary embodiment, the proximal vent valve sub (70) is welded to the main vent valve sub (72) and the main vent valve sub (72) is welded to the distal vent valve sub (74).

Referring to FIGS. 2-3, in the exemplary embodiment, a proximal end of the proximal vent valve sub (70) is provided with internal threads and a distal end of the distal vent valve sub (74) is provided with external threads.

In the exemplary embodiment, the distal end of the main packer sub (62) is connected with the proximal end of the proximal vent valve sub (70) by a threaded connection.

In the exemplary embodiment, the crossover spacer sub (36), the switch valve sub (38), the control valve sub (40), the pump drive sub (42), the second pump sub (44) and the first pump sub (46) are all contained within a main housing (80). In the exemplary embodiment, a proximal end of the main housing (80) is provided with internal threads which engage with the external threads on the distal end of the distal vent valve sub (74) to provide a threaded connection (82) between the distal vent valve sub (74) and the main housing (80).

In the exemplary embodiment, a proximal end of the packer transition sub (30) defines the proximal end (12) of the apparatus (10). In the exemplary embodiment, the main housing (80) extends distally below the first pump sub (46) so that a distal end of the main housing (80) defines the distal end (14) of the apparatus (10).

In the exemplary embodiment, the packer transition sub (30) contains and/or defines conduits for providing communication between the apparatus (10) and the wellbore (16) adjacent to the proximal end (12) of the apparatus (10), and for providing communication between the packer transition sub (30) and components of the apparatus (10) below the packer transition sub (30), as discussed in detail below.

In the exemplary embodiment, the packer transition sub (30) also defines a first pump outlet (84), a second pump inlet (86), and a gas outlet (88) adjacent to the proximal end (12) of the apparatus (10). A screen (not shown) may be provided at the second pump inlet (86) to inhibit the introduction of solids into the apparatus (10).

In the exemplary configuration of the apparatus (10) in a wellbore (16), the first pump outlet (84) may be connected with a liquid line (22) and the gas outlet (88) may be connected with a gas line (24), as depicted schematically in FIG. 1.

In the exemplary embodiment, the packer sub (32) contains and/or defines conduits for providing communication between the packer sub (32) and components of the apparatus (10) above and below the packer sub (32), as discussed in detail below.

The packer sub (32) also contains or carries a packer (90) as a sealing device for sealing the wellbore (16) to provide an upper wellbore section (92) proximal to the packer (90) and a lower wellbore section (94) distal to the packer (90).

Referring to FIG. 1, in the exemplary configuration for use of the apparatus (10), the lower wellbore section (94) communicates with the reservoir (18) so that the reservoir fluids enter the lower wellbore section (94), with the result that the lower wellbore section (94) contains a lower wellbore gas phase (not shown) at a lower wellbore gas pressure. The packer (90) maintains the lower wellbore gas phase at the lower wellbore gas pressure by isolating the lower wellbore section (94) from the upper wellbore section (92).

In the exemplary embodiment, the packer (90) is a mechanical packer which is mechanically actuated by manipulating a pipe string, coiled tubing or other running string (not shown) to which the apparatus (10) may be attached. In other embodiments, the packer (90) may be any suitable type of sealing device which is capable of providing a seal between the apparatus (10) and the wellbore (16) in order to seal the wellbore (16), as would be well known to a person skilled in the art. As a result, for simplicity, many details of the packer (90) are not shown in FIGS. 1-3.

In the exemplary embodiment, the vent valve sub (34) contains and/or defines conduits for providing communication between the vent valve sub (34) and components of the apparatus (10) above and below the vent valve sub (34), as discussed in detail below.

In the exemplary embodiment, the vent valve sub (34) also provides a gas inlet (100) for receiving the lower wellbore gas phase from the lower wellbore section (94). In the exemplary embodiment, the gas inlet (100) is comprised of three separate gas inlet ports (104) which are spaced around the circumference of the vent valve sub (34). In other embodiments, the gas inlet (100) may be comprised of a single gas inlet port (104) or any suitable number of gas inlet ports (104). In the exemplary embodiment, the gas inlet (100) is also comprised of a gas inlet chamber (106) which connects the gas inlet ports (104).

In the exemplary embodiment, the vent valve sub (34) also defines a vent (110) for venting a vented portion of the lower wellbore gas phase to the upper wellbore section (92). In the exemplary embodiment, the vent (110) is associated with the gas inlet (100) so that the vented portion of the lower wellbore gas phase is a portion of the lower wellbore gas phase which is received at the gas inlet (100).

In the exemplary embodiment, a vent valve (112) is associated with the vent (110). In the exemplary embodiment, the vent valve (112) is configured so that the vent (110) is open when the lower wellbore gas pressure is above a threshold gas pressure and so that the vent (110) is closed when the lower wellbore gas pressure is below a threshold gas pressure.

The vent (110) and the vent valve (112) can reduce the likelihood of damage to the apparatus (10) due to being exposed to an excess lower wellbore gas pressure. Accordingly, in the exemplary embodiment, the vent valve (112) is configured so that the threshold gas pressure is less than a pressure which will cause damage to the apparatus (10).

The vent (110) and the vent valve (112) can also facilitate additional production of the lower wellbore gas phase to the ground surface through the vent (110) in circumstances where high volumes of the lower wellbore gas phase and/or a high lower wellbore gas pressure are present.

In the exemplary embodiment, before being released to the upper wellbore section (92), the vented portion of the lower wellbore gas phase is vented to a gas outlet chamber (114) which is defined by the packer sub (32) and which communicates with the gas outlet (88).

In the exemplary embodiment, the crossover spacer sub (36) is comprised of a crossover spacer (120), which contains and/or defines conduits for providing communication between the crossover spacer sub (36) and components of the apparatus (10) above and below the crossover spacer sub (36), as discussed in detail below.

In the exemplary embodiment, a gasket (122) is provided between the vent valve sub (34) and the crossover spacer (120).

In the exemplary embodiment, the switch valve sub (38) contains and/or defines conduits for providing communication between the switch valve sub (38) and components of the apparatus (10) above and below the switch valve sub (38), as discussed in detail below.

The switch valve sub (38) also contains a switch valve (130). As a result, the switch valve sub (38) also contains and/or defines conduits which are associated with the functioning of the switch valve (130), as discussed in detail below.

In the exemplary embodiment, the switch valve (130) is a reciprocating switch valve which reciprocates between a first switch valve position (132) as shown in FIG. 2 and a second switch valve position (134) as shown in FIG. 3.

In the exemplary embodiment, the switch valve sub (38) and the switch valve (130) are constructed as a modular component. More particularly, in the exemplary embodiment, the switch valve (130) is comprised of a first switch valve module (136) and a second switch valve module (138). The switch valve modules (136, 138) are separated by a switch valve module spacer (140).

The first switch valve module (136) is comprised of a first switch valve piston (142) contained in a first switch valve cylinder (144) which is defined by the first switch valve module (136), and the second switch valve module (138) is comprised of a second switch valve piston (146) contained in a second switch valve cylinder (148) which is defined by the second switch valve module (138). The switch valve cylinders (144, 148) are separated by the switch valve module spacer (140). A switch valve linkage (150) extends through the switch valve module spacer (140) and connects the switch valve pistons (142, 146) with threaded connections so that the switch valve pistons (142, 146) reciprocate together.

A groove in the outer surface of the first switch valve piston (142) defines a first switch valve port (152). A groove in the outer surface of the second switch valve piston (146) defines a second switch valve port (154). O-ring seals (156) are provided on the outer surfaces of the switch valve pistons (142, 146) on both sides of the switch valve ports (146, 148) to seal and isolate the switch valve ports (146, 148).

Since the switch valve sub (38) and the switch valve (130) in the exemplary embodiment are constructed as a modular component, the switch valve (130) may easily be comprised of a single switch valve piston or may be comprised of more than two switch valve pistons simply by varying the number of switch valve modules and switch valve spacers which are included in the switch valve sub (38). In other embodiments, the switch valve sub (38) may be configured so that a plurality of switch valve pistons may be contained in a single switch valve cylinder, and/or the switch valve sub (38) may be configured as a non-modular component.

In the exemplary embodiment, a gasket (158) is provided between the crossover spacer (120) and the switch valve sub (38), and gaskets (160) are provided between each of the switch valve modules (136, 138) and the switch valve module spacer (140).

In the exemplary embodiment, the control valve sub (40) contains and/or defines conduits for providing communication between the control valve sub (40) and components of the apparatus (10) above and below the control valve sub (40), as discussed in detail below.

The control valve sub (40) also contains a control valve (170). As a result, the control valve sub (40) also contains and/or defines conduits which are associated with the functioning of the control valve (170), as discussed in detail below.

In the exemplary embodiment, the control valve (170) is a reciprocating control valve which reciprocates between a first control valve position (172) as shown in FIG. 2 and a second control valve position (174) as shown in FIG. 3.

In the exemplary embodiment, the control valve sub (40) and the control valve (170) are constructed as a modular component. More particularly, in the exemplary embodiment, the control valve (170) is comprised of first control valve module (176), a second control valve module (178), and a third control valve module (180). The first control valve module (176) and the second control valve module (178) are separated by a proximal control valve spacer (182). The second control valve module (178) and the third control valve module (180) are separated by a distal control valve spacer (184).

In the exemplary embodiment, the control valve (170) is comprised of a control valve piston (186) which is slidably carried on a control valve shaft (188). The control valve piston (186) and the control valve shaft (188) are contained in a control valve cylinder (189) which is defined by the control valve modules (176, 178, 180). A proximal control valve actuating member (190) is fixed to a proximal end of the control valve shaft (188) with a threaded connection. A distal control valve actuating member (192) is fixed to a distal end of the control valve shaft (188) with a threaded connection. The reciprocating movement of the control valve (170) is limited by a proximal control valve stop (194) which is defined by the proximal control valve spacer (182) and a distal control valve stop (196) which is defined by the distal control valve spacer (184).

Two grooves in the outer surface of the control valve piston (186) define a first control valve port (198) and a second control valve port (200). O-ring seals (202) are provided on the outer surface of the control valve piston (186) on both sides of the control valve ports (198, 200) to seal and isolate the control valve ports (188, 190).

Since the control valve sub (40) and the control valve (170) in the exemplary embodiment are constructed as a modular component, the number of control valve modules may easily be varied in order to accommodate a lesser or greater amount of reciprocation of the control valve shaft (188).

In the exemplary embodiment, the switch valve sub (38) and the control valve sub (40) are separated by a spacer plate (204). In the exemplary embodiment, gaskets (206) are provided between the switch valve sub (38) and the spacer plate (204) and between the spacer plate (204) and the control valve sub (40).

In the exemplary embodiment, gaskets (208) are also provided between the first and second control valve modules (176, 178) and the proximal control valve spacer (182) and between the second and third control valve modules (178, 180) and the distal control valve spacer (184).

In the exemplary embodiment, the pump drive sub (42) contains and/or defines conduits for providing communication between the pump drive sub (42) and components of the apparatus (10) above and below the pump drive sub (42), as discussed in detail below.

The pump drive sub (42) also contains a pump drive (220). As a result, the pump drive sub (42) also contains and/or defines conduits which are associated with the functioning of the pump drive (220), as discussed in detail below.

In the exemplary embodiment, the pump drive (220) is a reciprocating pump drive which reciprocates between a first pump drive position (222) as shown in FIG. 2 and a second pump drive position (224) as shown in FIG. 3.

In the exemplary embodiment, the pump drive sub (42) and the pump drive (220) are constructed as a modular component. More particularly, in the exemplary embodiment, the pump drive (220) is comprised of a first pump drive module (226), a second pump drive module (228), a third pump drive module (230), and a fourth pump drive module (232).

The pump drive modules (226, 228, 230, 232) are separated by pump drive spacers (234). In the exemplary embodiment, gaskets (235) are provided between the pump drive modules (226, 228, 230, 232) and the spacers (234).

In the exemplary embodiment, each of the pump drive modules (226, 228, 230, 232) provides a pump drive stage so that the pump drive (220) in the exemplary embodiment is comprised of four pump drive stages. In the exemplary embodiment, each pump drive module (226, 228, 230, 232) is comprised of a pump drive piston (236) and a pump drive module shaft (238) contained in a pump drive cylinder (240) which is defined by the corresponding pump drive module. The pump drive cylinders (240) are separated by the pump drive spacers (234).

Each pump drive module shaft (238) is fixed to its corresponding pump drive piston (236) with a threaded connection, extends from a distal end of the pump drive piston (236), and terminates below the distal end of its corresponding pump drive cylinder (240). In the exemplary embodiment, all of the pump drive pistons (236) are interconnected by the pump drive module shafts (238) with threaded connections so that the pump drive pistons (236) reciprocate together. The pump drive module shaft (238) of the most distal pump drive stage extends below the pump drive sub (42).

O-ring seals (242) are provided on the outer surface of the pump drive pistons (236) so that the pump drive pistons (236) sealingly engage the pump drive cylinders (240).

Since the pump drive sub (42) and the pump drive (220) in the exemplary embodiment are constructed as a modular component, the number of pump drive stages may easily be varied to provide fewer than four pump stages or more than four pump stages in order to reduce or increase the power of the pump drive (220).

In the exemplary embodiment, the control valve sub (40) and the pump drive sub (42) are separated by a spacer plate (244). In the exemplary embodiment, gaskets (246) are provided between the control valve sub (40) and the spacer plate (244) and between the spacer plate (244) and the pump drive sub (42).

In the exemplary embodiment, a control valve connector shaft (248) extends through the spacer plate (244) and is fixed to the most proximal pump drive piston (236) and the distal control valve actuating member (192) with threaded connections so that the pump drive pistons (236) and the control valve shaft (188) reciprocate together.

In the exemplary embodiment, the second pump sub (44) contains and/or defines conduits for providing communication between the second pump sub (44) and components of the apparatus (10) above and below the second pump sub (44), as discussed in detail below.

The second pump sub (44) also contains a second pump (260) for pumping fluids from the upper wellbore section (92) into the lower wellbore section (94). As a result, the second pump sub (44) also contains and/or defines conduits which are associated with the functioning of the second pump (260), as discussed in detail below.

In the exemplary embodiment, the second pump (260) is a reciprocating pump which reciprocates between a first second pump position (262) as shown in FIG. 2 and a second second pump position (264) as shown in FIG. 3.

In the exemplary embodiment, the second pump sub (44) and the second pump (260) are constructed as a modular component. More particularly, in the exemplary embodiment, the second pump (260) is comprised of a single second pump module (266) so that the second pump (260) is comprised of a single second pump stage.

In the exemplary embodiment, the second pump module (266) is comprised of a second pump piston (268) contained in a second pump cylinder (270) which is defined by the second pump module (266). The second pump piston (268) is fixed to the most distal pump drive module shaft (238) with a threaded connection so that the second pump piston (268) and the pump drive pistons (236) reciprocate together.

O-ring seals (272) are provided in the outer surface of the second pump piston (268) so that the second pump piston (268) sealingly engages the second pump cylinder (270).

Since the second pump sub (44) and the second pump (260) in the exemplary embodiment are constructed as a modular component, the number of second pump stages may easily be increased (similar to providing more than one pump drive stage) to provide more than one second pump stage in order to increase the pumping pressure and/or the pumping flowrate of the second pump (260).

In the exemplary embodiment, the pump drive sub (42) and the second pump sub (44) are separated by a spacer plate (274). In the exemplary embodiment, gaskets (276) are provided between the pump drive sub (42) and the spacer plate (274) and between the spacer plate (274) and the second pump sub (44).

In the exemplary embodiment, the most distal pump drive module shaft (238) extends through the spacer plate (274) in order to enable the most distal pump drive module shaft (238) to connect with the second pump piston (268).

In the exemplary embodiment, the first pump sub (46) contains and/or defines conduits for providing communication with components of the apparatus (10) above the first pump sub (46), as discussed in detail below.

The first pump sub (46) also contains a first pump (280) for pumping fluids from the lower wellbore section (94). As a result, the first pump sub (46) also contains and/or defines conduits which are associated with the functioning of the first pump (280), as discussed in detail below.

In the exemplary embodiment, the first pump (280) is a reciprocating pump which reciprocates between a first first pump position (282) as shown in FIG. 2 and a second first pump position (284) as shown in FIG. 3.

In the exemplary embodiment, the first pump sub (46) and the first pump (280) are constructed as a modular component. More particularly, in the exemplary embodiment, the first pump (280) is comprised of a single first pump module (286) so that the first pump (280) is comprised of a single first pump stage.

In the exemplary embodiment, the first pump module (286) is comprised of a first pump piston (288) and a first pump module shaft (290) contained in a first pump cylinder (292) which is defined by the first pump module (286).

The first pump module shaft (290) is fixed to the first pump piston (288) with a threaded connection, extends from a proximal end of the first pump piston (288), and is fixed to the second pump piston (268) with a threaded connection so that the first pump piston (288) and the second pump piston (268) reciprocate together.

O-ring seals (294) are provided in the outer surface of the first pump piston (288) so that the first pump piston (288) sealingly engages the first pump cylinder (292).

Since the first pump sub (46) and the first pump (280) in the exemplary embodiment are constructed as a modular component, the number of first pump stages may easily be increased (similar to providing more than one pump drive stage) to provide more than one first pump stage in order to increase the pumping pressure and/or the pumping flowrate of the first pump (280).

In the exemplary embodiment, the second pump sub (44) and the first pump sub (46) are separated by a spacer plate (296). In the exemplary embodiment, gaskets (298) are provided between the second pump sub (44) and the spacer plate (296) and between the spacer plate (296) and the first pump sub (46).

In the exemplary embodiment, the first pump module shaft (290) extends through the spacer plate (296) in order to enable the first pump module shaft (290) to connect with the second pump piston (268).

In the exemplary embodiment, a bottom plate (310) is provided at the distal end of the first pump sub (46). The bottom plate (310) contains and/or defines conduits for providing communication between the apparatus (10) and the wellbore (16) adjacent to the distal end (14) of the apparatus (10), and for providing communication between the bottom plate (310) and components of the apparatus (10) above the bottom plate (310), as discussed in detail below.

In the exemplary embodiment, the bottom plate (310) also defines a first pump inlet (312) and second pump outlet (314) adjacent to the distal end (14) of the apparatus (10). A screen (not shown) may be provided at the first pump inlet (312) to inhibit the introduction of solids into the apparatus (10).

In the exemplary embodiment, a gasket (316) is provided between the first pump sub (46) and the bottom plate (310).

As previously mentioned, each of the components of the apparatus (10) contains and/or defines conduits which are utilized for the operation of the apparatus (10).

The conduits include axial conduits and radial conduits. Axial conduits extend generally axially through the components and radial conduits extend generally radially from axial conduits.

In the exemplary embodiment, the components of the apparatus (10) are configured so that at least some of the components and modules of the apparatus (10) include the same configuration of axial conduits. In the exemplary embodiment, not all of the axial conduits may be used in each component, and some of the axial conduits may be extra or spare axial conduits which may not be used at all in the apparatus (10). In the exemplary embodiment, each of the axial conduits is located at a similar position in each of the components and modules. This configuration of the axial conduits simplifies the fabrication of the components and modules and assists in facilitating construction of the components as modular components.

Referring to FIGS. 2-3, in the exemplary embodiment, the apparatus (10) is comprised of the following axial conduits:

- axial conduit (401): this axial conduit (401) houses the switch valve pistons (142, 146), the control valve piston (186), the pump drive pistons (236), the second pump piston (268), and the first pump piston (288);
- axial conduit (402): this axial conduit (402), with associated radial conduits, is used to provide communication between the control valve (170) and a first side (328) of the switch valve pistons (142, 146);
- axial conduit (404): this axial conduit (404), with associated radial conduits, is used to provide a control line (330) for delivering a control portion of the lower wellbore gas phase to the control valve (170);
- axial conduit (405): this axial conduit (405), with associated radial conduits, is used to provide communication between the switch valve (130) and a first side (332) of the pump drive pistons (236), and to provide communication between the switch valve (130) and a first side (334) of the second pump piston (268);
- axial conduit (406): this axial conduit (406), with associated radial conduits, is used to provide communication between the first pump (280) and the first pump outlet (84);
- axial conduit (407): this axial conduit (407), with associated radial conduits, is used to provide communication between the gas inlet (100) and the switch valve (130)
- axial conduit (407'): this axial conduit (407'), with associated radial conduits, is used to provide communication between the switch valve (130) and a second side (338) of the pump drive pistons (236);
- axial conduit (408): this axial conduit (408), with associated radial conduits, is used to provide communication between the switch valve (130) and the gas outlet (88), to provide communication between the control valve (170) and the gas outlet (88), and to provide communication between the vent (100) and the gas outlet (88);
- axial conduit (410): this axial conduit (410), with associated radial conduits, is used to provide communication between the second pump inlet (86) and a second side (342) of the second pump piston (268), and to provide communication between the second side (342) of the second pump piston (268) and the second pump outlet (314). The axial conduit (410) and its associated radial conduits provide a second pump inlet line between the second pump inlet (86) and the second pump (260);
- axial conduit (411): this axial conduit (402), with associated radial conduits, is used to provide communication between the control valve (170) and a second side (344) of the switch valve pistons (142, 146).

In the exemplary embodiment, additional axial conduits (412, 414), with associated radial conduits, are used to provide communication between the first pump (280) and the first pump inlet (312). More specifically, in the exemplary embodiment, axial conduit (412) is used to provide communication between a first side (346) of the first pump piston (288) and the first pump inlet (312) and axial conduit (414) is used to provide communication between a second side (348) of the first pump piston (288) and the first pump inlet (312). The axial conduit (406), the axial conduits (412, 414) and their associated radial conduits provide a first pump outlet line between the first pump (280) and the first pump outlet (84).

The operation of the exemplary embodiment of the apparatus (10) is now described, with reference to FIG. 2 and FIG. 3.

In FIG. 2, the apparatus (10) is depicted in a first apparatus position, with the switch valve (130) in the first switch valve position (132), with the control valve (170) in the first control valve position (172), with the pump drive (220) in the first pump drive position (222), with the second pump (260) in the first second pump position (262), and with the first pump (280) in the first first pump position (282).

In FIG. 3, the apparatus (10) is depicted in a second apparatus position, with the switch valve (130) in the second switch valve position (134), with the control valve (170) in the second control valve position (174), with the pump drive (220) in the second pump drive position (224), with the second pump (260) in the second second pump position (264), and with the first pump (280) in the second first pump position (284).

The apparatus (10) is alternated between the first apparatus position and the second apparatus position by the combined operation of the pump drive (220) and a switch comprising the switch valve (130) and the control valve (170).

FIGS. 2-3 are based upon the exemplary configuration for the apparatus (10) in a wellbore (16), as depicted schematically in FIG. 1.

As a result, in FIGS. 2-3, the first pump outlet (84), the second pump inlet (86), and the gas outlet (88) communicate with the upper wellbore section (92), and the first pump inlet (312), the second pump outlet (314) and the gas inlet (100) communicate with the lower wellbore section (94).

Referring to FIGS. 2-3, the lower wellbore gas phase enters the apparatus (10) at the gas inlet (100). The gas inlet (100) communicates with the axial conduit (407) and with the vent (110). If the lower wellbore gas pressure is above a threshold gas pressure, the vent valve (112) is open so that a vented portion of the lower wellbore gas phase is vented to the gas outlet (88) via the axial conduit (408), thereby bypassing the pump drive (220). If the lower wellbore gas pressure is below the threshold gas pressure, the vent valve (112) is closed so that the only path for the lower wellbore gas phase through the apparatus (10) is through the axial conduit (407).

The axial conduit (402) is associated with radial conduits (402*a*, 402*b*, 402*c*). The radial conduit (402*a*) provides communication between the axial conduit (402) and the first side (328) of the switch valve piston (142). The radial conduit (402*b*) provides communication between the axial conduit (402) and the first side (328) of the switch valve piston (146). The radial conduit (402*c*) provides communication between the axial conduit (402) and the control valve (170).

The axial conduit (405) is associated with radial conduits (405*a*, 405*b*, 405*c*). The radial conduit (405*a*) provides communication between the axial conduit (405) and the switch valve (130). The radial conduits (405*b*) provide communication between the axial conduit (405) and the first side (332) of the pump drive pistons (236). The radial conduit (405*c*) provides communication between the axial conduit (405) and the first side (334) of the second pump piston (268). As a result, it can be seen that in the exemplary embodiment, the second pump (260) is adapted to be driven both by the pump drive (220) and directly by the lower wellbore gas pressure of the lower wellbore gas phase being exerted on the first side (334) of the second pump piston (268).

The axial conduit (407) is associated with radial conduits (407*a*, 407*b*). The radial conduits (407*a*, 407*b*) both provide communication between the axial conduit (407) and the switch valve (130). The axial conduit (407) delivers the lower wellbore gas phase in parallel to the switch valve (130) via radial conduits (407*a*, 407*b*) and to the control valve (170) via control line (330).

The axial conduit (407') is associated with radial conduits (407'*a*, 407'*b*). The radial conduit (407'*a*) provides communication between the axial conduit (407') and the switch valve (130). The radial conduits (407'*b*) provide communication between the axial conduit (407') and the second side (338) of the pump drive pistons (236).

The axial conduit (408) is associated with radial conduits (408*a*, 408*b*, 408*c*, 408*d*). The radial conduits (408*a*, 408*b*) provide communication between the axial conduit (408) and the switch valve (130). The radial conduits (408*c*, 408*d*) provide communication between the axial conduit (408) and the control valve (170).

The axial conduit (411) is associated with radial conduits (411*a*, 411*b*, 411*c*). The radial conduit (411*a*) provides communication between the axial conduit (411) and the second side (344) of the first switch valve piston (142). The radial conduit (411*b*) provides communication between the axial conduit (411) and the second side (344) of the second switch valve piston (146). The radial conduit (411*c*) provides communication between the axial conduit (411) and the control valve (170).

Referring to FIG. 2, in the first apparatus position:

(a) the radial conduit (407*a*) and the radial conduit (405*a*) are both aligned with the first switch valve port (152) so that the lower wellbore gas phase is delivered from the gas inlet (100) to the first side (332) of the pump drive pistons (236) and to the first side (334) of the second pump piston (268), thereby urging the pump drive pistons (236) toward the first pump drive position (222) and urging the second pump piston (268) toward the first second pump position (264);

(b) the radial conduit (407'*a*) and the radial conduit (408*b*) are both aligned with the second switch valve port (154) so that the lower wellbore gas phase is delivered from the second side (338) of the pump drive pistons (236) to the gas outlet (88), thereby purging the second side (338) of the pump drive pistons (236) of the lower wellbore gas phase;

(c) the radial conduit (408*c*) and the radial conduit (411*c*) are both aligned with the first control valve port (198) so that the lower wellbore gas phase is delivered from the second side (344) of the switch valve pistons (142, 146) to the gas outlet (88), thereby purging the second side (344) of the switch valve pistons (142, 146) of the lower wellbore gas phase; and (d) the control line (330) and the radial conduit (402*c*) are both aligned with the second control valve port (200) so that the lower wellbore gas phase is delivered from the gas inlet (100) to the first side (328) of the switch valve pistons (142, 146), thereby urging the switch valve pistons (142, 146) toward the first switch valve position (132).

Referring to FIG. 3, in the second apparatus position:

(a) the radial conduit (405*a*) and the radial conduit (408*a*) are both aligned with the first switch valve port (152) so that the lower wellbore gas phase is delivered from the first side (332) of the pump drive pistons (236) and from the first side (334) of the second pump piston (268) to the gas outlet (88), thereby purging the first side (332) of the pump drive pistons (236) and the first side (334) of the second pump piston (268) of the lower wellbore gas phase;

(b) the radial conduit (407*b*) and the radial conduit (407'*a*) are both aligned with the second switch valve port (154) so that the lower wellbore gas phase is delivered from the gas inlet (100) to the second side (338) of the pump drive pistons (236), thereby urging the pump drive pistons (236) toward the second pump drive position (224);

(c) the control line (330) and the radial conduit (411*c*) are both aligned with the first control valve port (198) so that the lower wellbore gas phase is delivered from the gas inlet (100) to the second side (344) of the switch valve pistons (142, 146), thereby urging the switch valve pistons (142, 146) toward the second switch valve position (134); and (d) the radial conduit (408*d*) and the radial conduit (402*c*) are both aligned with the second control valve port (200) so that the lower wellbore gas phase is delivered from the second side (344) of the switch valve pistons (142, 146) to the gas outlet (88), thereby purging the first side (328) of the switch valve pistons (142, 146) of the lower wellbore gas phase.

Referring to FIG. 2 and FIG. 3, it can be seen that the reciprocation of the pump drive pistons (236) is controlled by the switch valve (130), that the reciprocation of the switch valve pistons (142, 146) is controlled by the control valve (170), and that the reciprocation of the control valve piston (186) is controlled by the pump drive (220).

More particularly, the reciprocation of the control valve piston (186) is caused by the reciprocation of the control valve shaft (188), which is connected with the control valve connector shaft (248), and by the resulting reciprocation between the control valve stops (194, 196) of the control valve actuating members (190, 192), which are connected with the control valve shaft (188). The reciprocation of the control valve connector shaft (248) is in turn caused by the reciprocation of the pump drive pistons (236).

The second pump piston (268) and the first pump piston (288) are both connected with the pump drive (220). As a result, reciprocation of the pump drive pistons (236) causes reciprocation of both the second pump piston (268) and the first pump piston (288).

The axial conduit (410) is associated with radial conduits (410*a*, 410*b*). The radial conduit (410*a*) provides communication between the axial conduit (410) and the second pump inlet (86). The radial conduit (410*b*) provides communication between the axial conduit (410) and the second pump (260). The axial conduit (410) and the radial conduits (410*a*, 410*b*) together provide the second pump inlet line (340).

In the exemplary embodiment, the second pump (260) is a single acting pump, so that only the second side (342) of the second pump piston (268) is used to pump fluids from the upper wellbore section (92) to the lower wellbore section (94). As a result, in the exemplary embodiment, the radial conduit (410*b*) more particularly provides communication between the axial conduit (410) and the second side (342) of the second pump piston (268).

In the exemplary embodiment, a second pump check valve (350) is provided in the axial conduit (410) on each side of the junction between the axial conduit (410) and the radial conduit (410*b*), to facilitate pumping by the second pump (260) from the upper wellbore section (92) into the lower wellbore section (94) as the second pump piston (268) reciprocates.

The axial conduit (406) is associated with radial conduits (406*a*, 406*b*). The radial conduit (406*a*) provides communication between the axial conduit (406) and a pressure relief port (360) adjacent to the proximal end (12) of the apparatus (10). In the exemplary embodiment, a pressure relief device (362) is provided in the radial conduit (406*a*). In the exemplary embodiment, the pressure relief device (362) is comprised of a burst disc. The radial conduit (406*b*) provides communication between the axial conduit (406) and the axial conduits (412, 414).

The axial conduit (412) is associated with radial conduits (412*a*, 412*b*). The radial conduit (412*a*) provides communication between the axial conduit (412) and the first pump (280). The radial conduit (412*b*) provides communication between the axial conduit (412) and the first pump inlet (312).

The axial conduit (414) is associated with radial conduits (414*a*, 414*b*). The radial conduit (414*a*) provides communication between the axial conduit (414) and the first pump (280). The radial conduit (414*b*) provides communication between the axial conduit (414) and the first pump inlet (312).

In the exemplary embodiment, the first pump (280) is a double acting pump, so that both sides (346, 348) of the first pump piston (288) are used to pump fluids from the lower wellbore section (94). As a result, in the exemplary embodiment, the radial conduit (412*a*) more particularly provides communication between the axial conduit (412) and the first side (346) of the first pump piston (288), and the radial conduit (414*a*) more particularly provides communication between the axial conduit (414) and the second side (348) of the first pump piston (288).

In the exemplary embodiment, a first pump check valve (364) is provided in the axial conduits (412, 414) on both sides of the junctions between the axial conduits (412, 414) and the radial conduits (412*a*, 414*a*) respectively, to facilitate pumping by the first pump (280) from the upper wellbore section (92) as the first pump piston (288) reciprocates.

In the exemplary embodiment, a first pump outlet check valve (366) is provided in the axial conduit (406) adjacent to the first pump outlet (84), for preventing fluids from passing from the upper wellbore section (92) through the axial conduit (406). In the exemplary embodiment, the junction between the axial conduit (406) and the radial conduit (406*a*) is between the first pump outlet (84) and the first pump outlet check valve (366) and the pressure relief device (362) is configured to pressure in the axial conduit (406) before damage due to over-pressurization is caused to the first pump outlet check valve (366).

The method of the invention may be performed using any suitable apparatus or combination of apparatus, including an apparatus (10) within the scope of the invention. In some applications, the method of the invention may be performed using the exemplary embodiment of the apparatus (10) of the invention, as described above.

An exemplary embodiment of the method of the invention using the exemplary embodiment of the apparatus (10) of the invention may be performed as follows, with reference to FIGS. 1-3.

First, the apparatus (10) may be inserted in the wellbore (16). The apparatus (10) may be lowered into the wellbore (16) in any suitable manner, including on a pipe string, on coiled tubing, on a wireline, on a slickline, or on any other suitable running string and/or using any suitable running tool. In some applications, the apparatus (10) may be lowered into the wellbore (16) on jointed or coiled production tubing (not shown) and may remain attached to the production tubing during use of the apparatus (10).

Second, the wellbore (16) may be sealed by actuating the packer (90) as a sealing device to provide the upper wellbore section (92) and the lower wellbore section (94). The wellbore (16) may include a single producing interval or a plurality of producing intervals. If the wellbore (16) includes a single producing interval, the wellbore (16) is preferably sealed above the single producing interval. If the wellbore (16) includes a plurality of producing intervals, the wellbore (16) is preferably sealed above the highest (most proximal) producing interval if all producing intervals produce significant liquid, and is preferably sealed above the lowest (most distal) producing interval if the lowest producing interval produces gas and the upper producing intervals produce a low percentage of the total liquid production from the wellbore (16).

Third, the lower wellbore gas phase may be supplied to the pump drive (220) by allowing the lower wellbore gas phase to enter the apparatus (10) from the lower wellbore section (94) at the gas inlet (100). If the lower wellbore gas pressure is below a threshold gas pressure, all of the lower wellbore gas phase which enters the apparatus (10) at the gas inlet (100) will be available to power the pump drive. If the lower wellbore gas pressure is above the threshold gas pressure, a vented portion of the lower wellbore gas phase may be vented to the upper wellbore section (92) so that the vented portion of the lower wellbore gas phase bypasses the pump drive (220).

Fourth, the first pump (280) may be driven by the pump drive (220) to pump fluids from the lower wellbore section (94) and the second pump (260) may be driven by the pump drive (220) to pump fluids from the upper wellbore section (92) into the lower wellbore section.

Apparatus and methods within the scope of the invention may be suitable for use in many applications in which reservoir gas and reservoir gas pressure is available to power the pump drive. In many applications, no external power is required in order to power an apparatus within the scope of the invention, with the result that the invention may be used in remote locations with little or no surface equipment being required. The potential for little or no surface equipment can result in very little noise being present at the ground surface during use of the invention.

Apparatus and methods within the scope of the invention may also be suitable for use in a wide range of reservoir conditions and wellbore configurations. In many applications, little or no wellbore modification may be required to facilitate use of apparatus and methods within the scope of the invention.

Apparatus and methods within the scope of the invention may be particularly suited for use in gas wells and in high gas-to-oil ratio (GOR) oil wells, and/or wells which may experience issues relating to liquid loading.

Apparatus and methods within the scope of the invention may be used in vertical wellbores and/or in deviated wellbores. For best results in highly deviated wellbores (having deviation angles greater than ninety degrees), the sealing device is preferably positioned in the wellbore at a location which is above or proximal to the point where the wellbore first experiences a ninety degree deviation angle (i.e., a horizontal orientation).

Apparatus and methods within the scope of the invention may be used in wellbores having a wide range of liquid loading and/or liquid production rates, in wellbores having a wide range of reservoir gas volumes and/or gas production rates, and in wellbores having a wide range of reservoir gas pressures, by varying the design parameters of the apparatus.

Apparatus and methods within the scope of the invention which include the second pump (260) facilitate the pumping from the upper wellbore section (92) to the lower wellbore section (94) of various fluids, including liquid which accumulates in the upper wellbore section (92) during use of the apparatus, wellbore or reservoir treatment fluids, and/or fluids which may be used to initiate the operation of the apparatus in the event of stalling of the apparatus during use or in the event of insufficient lower wellbore gas pressure being available to overcome friction and inertia in order to initiate operation of the apparatus.

The practicality of pumping fluids from the upper wellbore section (92) to the lower wellbore section (94) with the second pump (260) can be enhanced by the inclusion of the first pump outlet check valve (366), the pressure relief port (360) and the pressure relief device (362), which can reduce the likelihood of damage to the first pump (280) or other components of the apparatus (10) if fluids are introduced into the upper wellbore section (92) under pressure to facilitate their passing through the second pump (260).

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The embodiments of the invention in which an exclusive property or privilege is claimed are defined as follows:

1. An apparatus for insertion in a wellbore in order to move fluids in the wellbore, wherein the wellbore communicates with an underground reservoir containing reservoir fluids such that the reservoir fluids enter the wellbore, wherein the reservoir fluids are comprised of a gas phase, and wherein the apparatus comprises:

(a) a sealing device adapted for sealing the wellbore in order to provide an upper wellbore section proximal to the sealing device and a lower wellbore section distal to the sealing device, so that a lower wellbore gas phase which is contained in the lower wellbore section is maintained at a lower wellbore gas pressure;

(b) a first pump for pumping fluids from the lower wellbore section, wherein the first pump comprises a first pump inlet in communication with the lower wellbore section;

(c) a second pump for pumping fluids from the upper wellbore section into the lower wellbore section, wherein the second pump comprises a second pump inlet in communication with the upper wellbore section, a second pump outlet in communication with the lower wellbore section, a second pump inlet line connecting the second pump with the second pump inlet, and a second pump outlet line connecting the second pump with the second pump outlet, so that fluids pumped by the second pump from the upper wellbore section into the lower wellbore section are pumped from the lower wellbore section by the first pump;

(d) a pump drive operably connected to the first pump and the second pump, for driving the first pump and the second pump, wherein the pump drive is adapted to be powered using the lower wellbore gas pressure of the lower wellbore gas phase;

(e) a gas inlet in communication with the lower wellbore section, for receiving the lower wellbore gas phase from the lower wellbore section in order to supply the lower wellbore gas phase to the pump drive; and (f) a gas outlet in communication with the upper wellbore section, for exhausting the lower wellbore gas phase from the pump drive into the upper wellbore section.

2. The apparatus as claimed in claim 1 wherein the apparatus has a proximal end and a distal end, wherein the first pump, the second pump and the pump drive are axially spaced between the proximal end and the distal end, and wherein the first pump is located axially between the pump drive and the distal end.

3. The apparatus as claimed in claim 1 wherein the apparatus has a proximal end and a distal end, wherein the first pump, the second pump and the pump drive are axially spaced between the proximal end and the distal end, and wherein the second pump is located axially between the pump drive and the distal end.

4. The apparatus as claimed in claim 3 wherein the second pump is located axially between the pump drive and the first pump.

5. The apparatus as claimed in claim 1 wherein the apparatus has a proximal end and a distal end, wherein the sealing device is located axially between the proximal end and the distal end, and wherein the first pump inlet is adjacent to the distal end of the apparatus.

6. The apparatus as claimed in claim 5 wherein the second pump outlet is adjacent to the distal end of the apparatus.

7. The apparatus as claimed in claim 6 wherein the second pump inlet is adjacent to the proximal end of the apparatus.

8. The apparatus as claimed in claim 7 wherein the second pump inlet line extends axially through the apparatus between the second pump inlet and the second pump and wherein the second pump outlet line extends axially through the apparatus between the second pump and the second pump outlet.

9. The apparatus as claimed in claim 1 wherein the apparatus has a proximal end and a distal end, wherein the sealing device is located axially between the proximal end and the distal end, wherein the first pump has a first pump outlet, and wherein the first pump outlet is adjacent to the proximal end of the apparatus.

10. The apparatus as claimed in claim 9, further comprising a first pump outlet line extending axially through the apparatus between the first pump and the first pump outlet.

11. The apparatus as claimed in claim 10, further comprising a first pump outlet check valve positioned in the first pump outlet line adjacent to the first pump outlet, for preventing fluids from passing from the upper wellbore section through the first pump outlet line.

12. The apparatus as claimed in claim 11, further comprising a pressure relief device positioned in the first pump outlet line between the first pump outlet and the first pump outlet check valve.

13. The apparatus as claimed in claim 1 wherein the second pump is adapted to be driven directly by the lower wellbore gas pressure in addition to being driven by the pump drive.

14. The apparatus as claimed in claim 1, further comprising a vent for venting to the upper wellbore section a vented portion of the lower wellbore gas phase so that the vented portion of the lower wellbore gas phase bypasses the pump drive.

15. The apparatus as claimed in claim 14 wherein the first pump is a reciprocating pump, wherein the second pump is a reciprocating pump, and wherein the pump drive is a reciprocating pump drive, further comprising:

(g) a switch for alternately directing the lower wellbore gas phase received at the gas inlet to opposite sides of the pump drive in order to reciprocate the pump drive, wherein the switch is comprised of:

(i) a reciprocating switch valve, wherein the switch valve reciprocates between a first switch valve position in which the lower wellbore gas phase is directed to a first side of the pump drive and a second switch valve position in which the lower wellbore gas phase is directed to a second side of the pump drive;

(ii) a reciprocating control valve, wherein the control valve is reciprocated by the pump drive between a first control valve position in which a control portion of the lower wellbore gas phase which is received at the gas inlet is directed to a first side of the switch valve in order to reciprocate the switch valve to the first switch valve position and a second control valve position in which the control portion of the lower wellbore gas phase is directed to a second side of the switch valve in order to reciprocate the switch valve to the second switch valve position; and (iii) a control line for delivering the control portion of the lower wellbore gas phase to the control valve, wherein the control line is configured so that the lower wellbore gas phase is received at the gas inlet and is delivered to the switch valve and to the control valve in parallel.

16. The apparatus as claimed in claim 15 wherein the switch valve is comprised of a plurality of switch valve pistons and a switch valve linkage connecting the switch valve pistons so that the switch valve pistons reciprocate together, wherein the control portion of the lower wellbore gas phase is directed to a first side of all of the switch valve pistons when the control valve is in the first control valve position in order to reciprocate the switch valve to the first switch valve position, and wherein the control portion of the lower wellbore gas phase is directed to a second side of all of the switch valve pistons when the control valve is in the second control valve position in order to reciprocate the switch valve to the second switch valve position.

17. The apparatus as claimed in claim 14 wherein the first pump is a reciprocating pump, wherein the second pump is a reciprocating pump, and wherein the pump drive is a reciprocating pump drive, further comprising:

(g) a switch for alternately directing the lower wellbore gas phase received at the gas inlet to opposite sides of the pump drive in order to reciprocate the pump drive, wherein the switch is comprised of:

(i) a reciprocating switch valve, wherein the switch valve reciprocates between a first switch valve position in which the lower wellbore gas phase is directed to a first side of the pump drive and a second switch valve position in which the lower wellbore gas phase is directed to a second side of the pump drive, wherein the switch valve is comprised of a plurality of switch valve pistons and a switch valve linkage connecting the switch valve pistons so that the switch valve pistons reciprocate together; and (ii) a reciprocating control valve, wherein the control valve is reciprocated by the pump drive between a first control valve position in which a control portion of the lower wellbore gas phase is directed to a first side of all of the switch valve pistons in order to reciprocate the switch valve to the first switch valve position and a second control valve position in which the control portion of the lower wellbore gas phase is directed to a second side of all of the switch valve pistons in order to reciprocate the switch valve to the second switch valve position.

18. The apparatus as claimed in claim 1 wherein the first pump is a reciprocating pump, wherein the second pump is a reciprocating pump, and wherein the pump drive is a reciprocating pump drive, further comprising:

(g) a switch for alternately directing the lower wellbore gas phase received at the gas inlet to opposite sides of the pump drive in order to reciprocate the pump drive, wherein the switch is comprised of:

(i) a reciprocating switch valve, wherein the switch valve reciprocates between a first switch valve position in which the lower wellbore gas phase is directed to a first side of the pump drive and a second switch valve position in which the lower wellbore gas phase is directed to a second side of the pump drive;

(ii) a reciprocating control valve, wherein the control valve is reciprocated by the pump drive between a first control valve position in which a control portion of the lower wellbore gas phase which is received at the gas inlet is directed to a first side of the switch valve in order to reciprocate the switch valve to the first switch valve position and a second control valve position in which the control portion of the lower wellbore gas phase is directed to a second side of the switch valve in order to reciprocate the switch valve to the second switch valve position; and (iii) a control line for delivering the control portion of the lower wellbore gas phase to the control valve, wherein the control line is configured so that the lower wellbore gas phase is received at the gas inlet and is delivered to the switch valve and to the control valve in parallel.

19. The apparatus as claimed in claim 18 wherein the switch valve is comprised of a plurality of switch valve pistons and a switch valve linkage connecting the switch valve pistons so that the switch valve pistons reciprocate together, wherein the control portion of the lower wellbore gas phase is directed to a first side of all of the switch valve pistons when the control valve is in the first control valve position in order to reciprocate the switch valve to the first switch valve position, and wherein the control portion of the lower wellbore gas phase is directed to a second side of all of the switch valve pistons when the control valve is in the second control valve position in order to reciprocate the switch valve to the second switch valve position.

20. The apparatus as claimed in claim 1 wherein the first pump is a reciprocating pump, wherein the second pump is a reciprocating pump, and wherein the pump drive is a reciprocating pump drive, further comprising:

(g) a switch for alternately directing the lower wellbore gas phase received at the gas inlet to opposite sides of the pump drive in order to reciprocate the pump drive, wherein the switch is comprised of:

(i) a reciprocating switch valve, wherein the switch valve reciprocates between a first switch valve position in which the lower wellbore gas phase is directed to a first side of the pump drive and a second switch valve position in which the lower wellbore gas phase is directed to a second side of the pump drive, wherein the switch valve is comprised of a plurality of switch valve pistons and a switch valve linkage connecting the switch valve pistons so that the switch valve pistons reciprocate together; and (ii) a reciprocating control valve, wherein the control valve is reciprocated by the pump drive between a first control valve position in which a control portion of the lower wellbore gas phase is directed to a first side of all of the switch valve pistons in order to reciprocate the switch valve to the first switch valve position and a second control valve position in which the control portion of the lower wellbore gas phase is directed to a second side of all of the switch valve pistons in order to reciprocate the switch valve to the second switch valve position.

21. An apparatus for insertion in a wellbore in order to move fluids in the wellbore, wherein the wellbore communicates with an underground reservoir containing reservoir fluids such that the reservoir fluids enter the wellbore, wherein the reservoir fluids are comprised of a gas phase, and wherein the apparatus comprises:

(a) a sealing device adapted for sealing the wellbore in order to provide an upper wellbore section proximal to the sealing device and a lower wellbore section distal to the sealing device, so that a lower wellbore gas phase which is contained in the lower wellbore section is maintained at a lower wellbore gas pressure;

(b) a first pump for pumping fluids from the lower wellbore section;

(c) a pump drive operably connected to the first pump, for driving the first pump, wherein the pump drive is adapted to be powered using the lower wellbore gas pressure of the lower wellbore gas phase;

(d) a gas inlet in communication with both the lower wellbore section and the pump drive, for receiving the lower wellbore gas phase from the lower wellbore section in order to supply the lower wellbore gas phase to the pump drive;

(e) a gas outlet in communication with both the upper wellbore section and the pump drive, for exhausting the lower wellbore gas phase from the pump drive into the upper wellbore section; and (f) a vent for venting to the upper wellbore section a vented portion of the lower wellbore gas phase so that the vented portion of the lower wellbore gas phase bypasses the pump drive, wherein the vent is in communication with both the gas inlet and the gas outlet so that the vented portion of the lower wellbore gas phase is received by the apparatus through the gas inlet and is vented from the apparatus through the gas outlet.

22. The apparatus as claimed in claim 21 wherein the vented portion of the lower wellbore gas phase is a portion of the lower wellbore gas phase which is received at the gas inlet.

23. The apparatus as claimed in claim 21, further comprising a vent valve associated with the vent, wherein the vent valve is configured so that the vent is open when the lower wellbore gas pressure is above a threshold gas pressure and so that the vent is closed when the lower wellbore gas pressure is below the threshold gas pressure.

24. The apparatus as claimed in claim 21 wherein the first pump is a reciprocating pump and wherein the pump drive is a reciprocating pump drive, further comprising:

(g) a switch for alternately directing the lower wellbore gas phase received at the gas inlet to opposite sides of the pump drive in order to reciprocate the pump drive, wherein the switch is comprised of:

(i) a reciprocating switch valve, wherein the switch valve reciprocates between a first switch valve position in which the lower wellbore gas phase is directed to a first side of the pump drive and a second switch valve position in which the lower wellbore gas phase is directed to a second side of the pump drive;

(ii) a reciprocating control valve, wherein the control valve is reciprocated by the pump drive between a first control valve position in which a control portion of the lower wellbore gas phase which is received at the gas inlet is directed to a first side of the switch valve in order to reciprocate the switch valve to the first switch valve position and a second control valve position in which the control portion of the lower wellbore gas phase is directed to a second side of the switch valve in order to reciprocate the switch valve to the second switch valve position, and (iii) a control line for delivering the control portion of the lower wellbore gas phase to the control valve, wherein the control line is configured so that the lower wellbore gas phase is received at the gas inlet and is delivered to the switch valve and to the control valve in parallel.

25. The apparatus as claimed in claim 24 wherein the switch valve is comprised of a plurality of switch valve pistons and a switch valve linkage connecting the switch valve pistons so that the switch valve pistons reciprocate together, wherein the control portion of the lower wellbore gas phase is directed to a first side of all of the switch valve pistons when the control valve is in the first control valve position in order to reciprocate the switch valve to the first switch valve position, and wherein the control portion of the lower wellbore gas phase is directed to a second side of all of the switch valve pistons when the control valve is in the second control valve position in order to reciprocate the switch valve to the second switch valve position.

26. The apparatus as claimed in claim 21 wherein the first pump is a reciprocating pump and wherein the pump drive is a reciprocating pump drive, further comprising:

(g) a switch for alternately directing the lower wellbore gas phase received at the gas inlet to opposite sides of the pump drive in order to reciprocate the pump drive, wherein the switch is comprised of:

(i) a reciprocating switch valve, wherein the switch valve reciprocates between a first switch valve position in which the lower wellbore gas phase is directed to a first side of the pump drive and a second switch valve position in which the lower wellbore gas phase is directed to a second side of the pump drive, wherein the switch valve is comprised of a plurality of switch valve pistons and a switch valve linkage connecting the switch valve pistons so that the switch valve pistons reciprocate together; and (ii) a reciprocating control valve, wherein the control valve is reciprocated by the pump drive between a first control valve position in which a control portion of the lower wellbore gas phase is directed to a first side of all of the switch valve pistons in order to reciprocate the switch valve to the first switch valve position and a second control valve position in which the control portion of the lower wellbore gas phase is directed to a second side of all of the switch valve pistons in order to reciprocate the switch valve to the second switch valve position.

27. The apparatus as claimed in claim 21, further comprising a gas outlet chamber between the vent and the gas outlet, wherein the vented portion of the lower wellbore gas phase is vented to the gas outlet chamber before being released to the upper wellbore section through the gas outlet.

28. The apparatus as claimed in claim 27 wherein the gas outlet chamber is between the pump drive and the gas outlet, and wherein the exhausted lower wellbore gas phase from the pump drive is received in the gas outlet chamber before being released to the upper wellbore section through the gas outlet.

29. The apparatus as claimed in claim 28, further comprising a conduit for providing communication between the vent and the gas outlet chamber.

30. The apparatus as claimed in claim 29 wherein the conduit further provides communication between the pump drive and the gas outlet chamber.

31. An apparatus for insertion in a wellbore in order to move fluids in the wellbore, wherein the wellbore communicates with an underground reservoir containing reservoir fluids such that the reservoir fluids enter the wellbore, wherein the reservoir fluids are comprised of a gas phase, and wherein the apparatus comprises:

(a) a sealing device adapted for sealing the wellbore in order to provide an upper wellbore section proximal to the sealing device and a lower wellbore section distal to the sealing device, so that a lower wellbore gas phase which is contained in the lower wellbore section is maintained at a lower wellbore gas pressure;

(b) a reciprocating first pump for pumping fluids from the lower wellbore section;

(c) a reciprocating pump drive operably connected to the first pump, for driving the first pump, wherein the pump drive is adapted to be powered using the lower wellbore gas pressure of the lower wellbore gas phase;

(d) a gas inlet in communication with the lower wellbore section, for receiving the lower wellbore gas phase from the lower wellbore section in order to supply the lower wellbore gas phase to the pump drive;

(e) a gas outlet in communication with the upper wellbore section, for exhausting the lower wellbore gas phase from the pump drive into the upper wellbore section; and (f) a switch for alternately directing the lower wellbore gas phase received at the gas inlet to opposite sides of the pump drive in order to reciprocate the pump drive, wherein the switch is comprised of:

(i) a reciprocating switch valve, wherein the switch valve reciprocates between a first switch valve position in which the lower wellbore gas phase is directed to a first side of the pump drive and a second switch valve position in which the lower wellbore gas phase is directed to a second side of the pump drive;

(ii) a reciprocating control valve, wherein the control valve is reciprocated by the pump drive between a first control valve position in which a control portion of the lower wellbore gas phase which is received at the gas inlet is directed to a first side of the switch valve in order to reciprocate the switch valve to the first switch valve position and a second control valve position in which the control portion of the lower wellbore gas phase is directed to a second side of the switch valve in order to reciprocate the switch valve to the second switch valve position; and (iii) a control line for delivering the control portion of the lower wellbore gas phase to the control valve, wherein the control line is configured so that the lower wellbore gas phase is received at the gas inlet and is delivered to the switch valve and to the control valve in parallel.

32. The apparatus as claimed in claim 31 wherein the switch valve is comprised of a plurality of switch valve pistons and a switch valve linkage connecting the switch valve pistons so that the switch valve pistons reciprocate together, wherein the control portion of the lower wellbore gas phase is directed to a first side of all of the switch valve pistons when the control valve is in the first control valve position in order to reciprocate the switch valve to the first switch valve position, and wherein the control portion of the lower wellbore gas phase is directed to a second side of all of the switch valve pistons when the control valve is in the second control valve position in order to reciprocate the switch valve to the second switch valve position.

33. An apparatus for insertion in a wellbore in order to move fluids in the wellbore, wherein the wellbore communicates with an underground reservoir containing reservoir fluids such that the reservoir fluids enter the wellbore, wherein the reservoir fluids are comprised of a gas phase, and wherein the apparatus comprises:

(a) a sealing device adapted for sealing the wellbore in order to provide an upper wellbore section proximal to the sealing device and a lower wellbore section distal to the sealing device, so that a lower wellbore gas phase which is contained in the lower wellbore section is maintained at a lower wellbore gas pressure;

(b) a reciprocating first pump for pumping fluids from the lower wellbore section;

(c) a reciprocating pump drive operably connected to the first pump, for driving the first pump, wherein the pump drive is adapted to be powered using the lower wellbore gas pressure of the lower wellbore gas phase;

(d) a gas inlet in communication with the lower wellbore section, for receiving the lower wellbore gas phase from the lower wellbore section in order to supply the lower wellbore gas phase to the pump drive;

(e) a gas outlet in communication with the upper wellbore section, for exhausting the lower wellbore gas phase from the pump drive into the upper wellbore section; and (f) a switch for alternately directing the lower wellbore gas phase received at the gas inlet to opposite sides of the pump drive in order to reciprocate the pump drive, wherein the switch is comprised of:

(i) a reciprocating switch valve, wherein the switch valve reciprocates between a first switch valve position in which the lower wellbore gas phase is directed to a first side of the pump drive and a second switch valve position in which the lower wellbore gas phase is directed to a second side of the pump drive, wherein the switch valve is comprised of a plurality of switch valve pistons and a switch valve linkage connecting the switch valve pistons so that the switch valve pistons reciprocate together; and (ii) a reciprocating control valve, wherein the control valve is reciprocated by the pump drive between a first control valve position in which a control portion of the lower wellbore gas phase is directed to a first side of all of the switch valve pistons in order to reciprocate the switch valve to the first switch valve position and a second control valve position in which the control portion of the lower wellbore gas phase is directed to a second side of all of the switch valve pistons in order to reciprocate the switch valve to the second switch valve position.

34. A method for moving fluids in a wellbore, wherein the wellbore communicates with an underground reservoir containing reservoir fluids such that the reservoir fluids enter the wellbore, wherein the reservoir fluids are comprised of a gas phase, and wherein the method comprises:

(a) sealing the wellbore in order to provide an upper wellbore section and a lower wellbore section, so that a lower wellbore gas phase which is contained in the lower wellbore section is maintained at a lower wellbore gas pressure;

(b) supplying the lower wellbore gas phase to a pump drive in order to power the pump drive, wherein the pump drive is adapted to be powered using the lower wellbore gas pressure of the lower wellbore gas phase;

(c) driving a first pump with the pump drive in order to pump fluids from the lower wellbore section; and (d) driving a second pump with the pump drive in order to pump fluids from the upper wellbore section into the lower wellbore section so that fluids pumped by the second pump from the upper wellbore section into the lower wellbore section are pumped from the lower wellbore section by the first pump.

35. A method for moving fluids in a wellbore, wherein the wellbore communicates with an underground reservoir containing reservoir fluids such that the reservoir fluids enter the wellbore, wherein the reservoir fluids are comprised of a gas phase, and wherein the method comprises:

(a) sealing the wellbore in order to provide an upper wellbore section and a lower wellbore section, so that a lower wellbore gas phase which is contained in the lower wellbore section is maintained at a lower wellbore gas pressure;

(b) receiving the lower wellbore gas phase from the lower wellbore section through a gas inlet which is in communication with the lower wellbore section;

(c) supplying the lower wellbore gas phase from the gas inlet to a pump drive in order to power the pump drive, wherein the pump drive is adapted to be powered using the lower wellbore gas pressure of the lower wellbore gas phase;

(d) exhausting the lower wellbore gas phase from the pump drive into the upper wellbore section through a gas outlet which is in communication with the upper wellbore section;

(e) driving a first pump with the pump drive in order to pump fluids from the lower wellbore section; and (f) venting to the upper wellbore section a vented portion of the lower wellbore gas phase through a vent so that the vented portion of the lower wellbore gas phase bypasses the pump drive, wherein the vent is in communication with both the gas inlet and the gas outlet so that the vented portion of the lower wellbore gas phase is received through the gas inlet and is vented through the gas outlet.

36. The method as claimed in claim 35 wherein the venting occurs when the lower wellbore gas pressure is above a threshold gas pressure.

37. The method as claimed in claim 35, further comprising driving a second pump with the pump drive in order to pump fluids from the upper wellbore section into the lower wellbore section.

* * * * *